United States Patent [19]

Grossman

[11] 4,389,748

[45] Jun. 28, 1983

[54] CONCEALED DOOR HINGE

[76] Inventor: Morris G. Grossman, #5 Horizon Rd., Fort Lee, N.J. 07024

[21] Appl. No.: 267,017

[22] Filed: May 26, 1981

Related U.S. Application Data

[63] Continuation-in-part of Ser. No. 131,487, Mar. 13, 1980, and Ser. No. 93,448, Nov. 13, 1979, abandoned.

[51] Int. Cl.[3] ..... E05D 3/06; E05D 308; E05D 3/10; E05D 15/52

[52] U.S. Cl. ..... 16/278; 16/302; 16/303; 16/307; 16/366; 16/371

[58] Field of Search ..... 16/254, 258, 278, 288, 16/241, 294, 302, 303, 307, 383, 366, 371, 245

[56] References Cited

U.S. PATENT DOCUMENTS

| | | | |
|---|---|---|---|
| 3,835,585 | 9/1974 | Anderson et al. | 16/254 X |
| 3,864,786 | 2/1975 | Salice | 16/278 |
| 3,952,368 | 4/1976 | Zernig et al. | 16/291 |
| 4,083,082 | 4/1978 | Holmes | 16/288 |
| 4,091,500 | 5/1978 | Lautenschläger | 16/383 |
| 4,099,293 | 7/1978 | Pittasch | 16/245 |

*Primary Examiner*—Paul A. Bell
*Attorney, Agent, or Firm*—Lilling & Greenspan

[57] ABSTRACT

A new and novel concealed door hinge is disclosed and includes three pivot points, all of which are hidden when the door is closed. The device includes a substantially right angle interior leaf secured to the cabinet and a cup-like external leaf secured within a recess in the door. A forcing member is pivotally connected to one of the surfaces of the interior leaf and a pivoting member is pivotally connected to another surface of the internal leaf and to the external leaf. In one embodiment of the invention, when closing the door, a cam-like structure within the external leaf moves the forcing member to urge the pivoting member toward the door opening and, consequently, causes the entire hinge assembly to close. In another embodiment of the invention, the pivot point between the forcing member and the interior leaf is slidingly positioned with respect to the interior leaf. This embodiment also includes an axle which interconnects the forcing member and the pivoting member. This hinge assembly is particularly useful in cabinets positioned closely together or in recessed door cabinets where there is a small amount of room for the door to open and where it is desirable to open the door beyond 90° as on cabinets, vehicles, safes and the like.

90 Claims, 33 Drawing Figures

FIG. 3
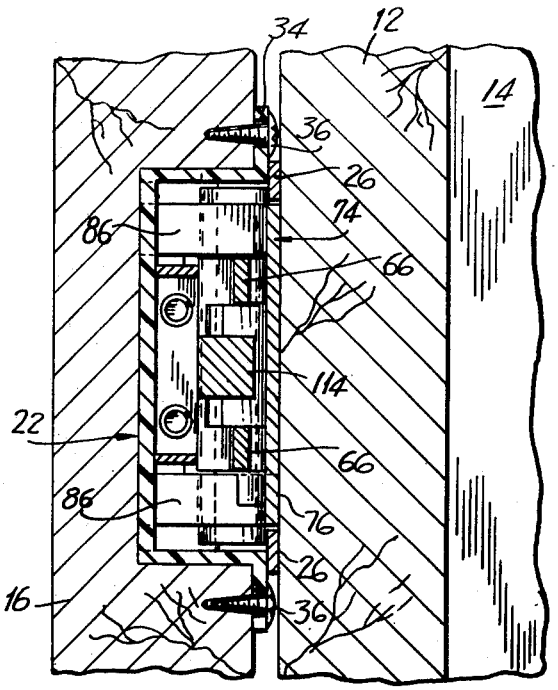
FIG. 7
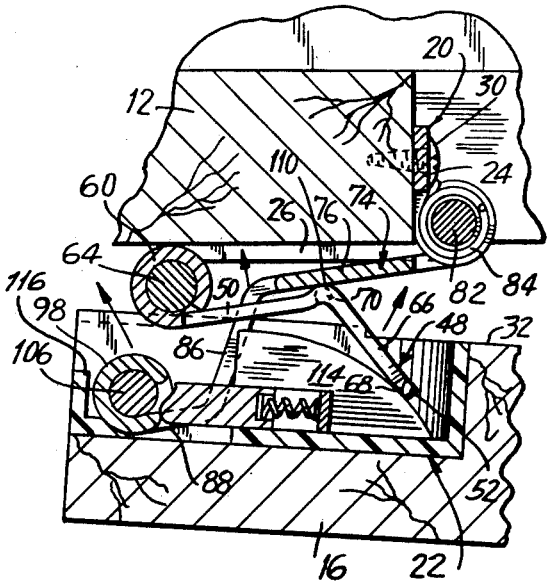
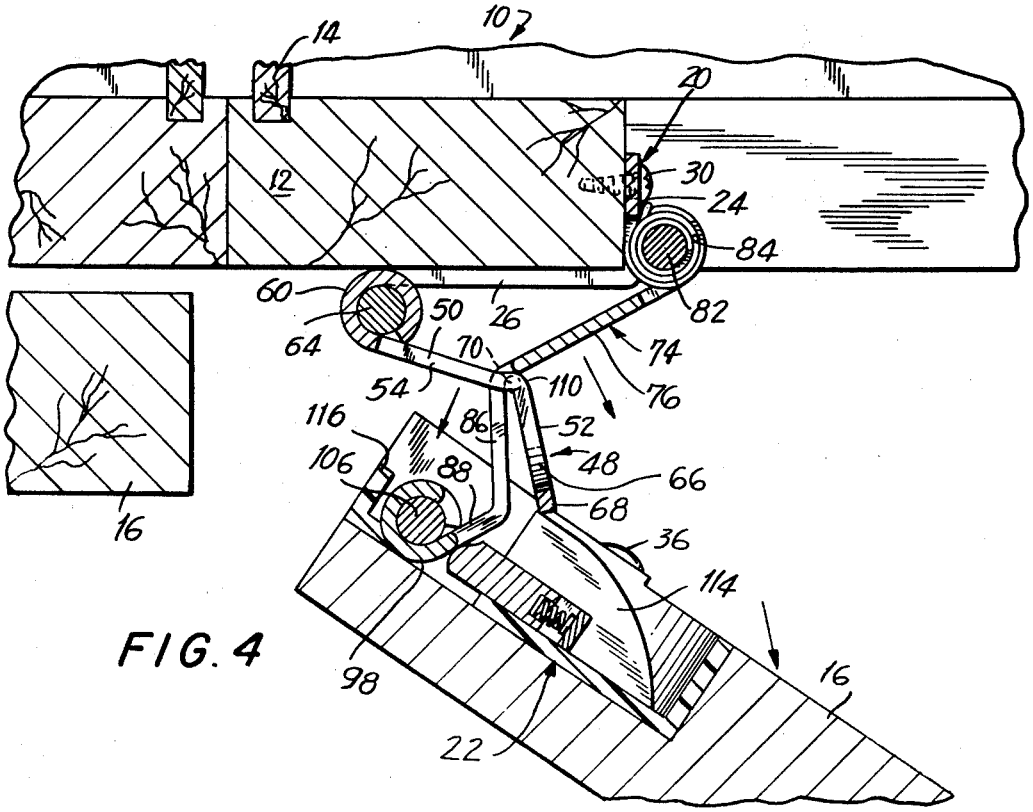
FIG. 4

FIG. 15
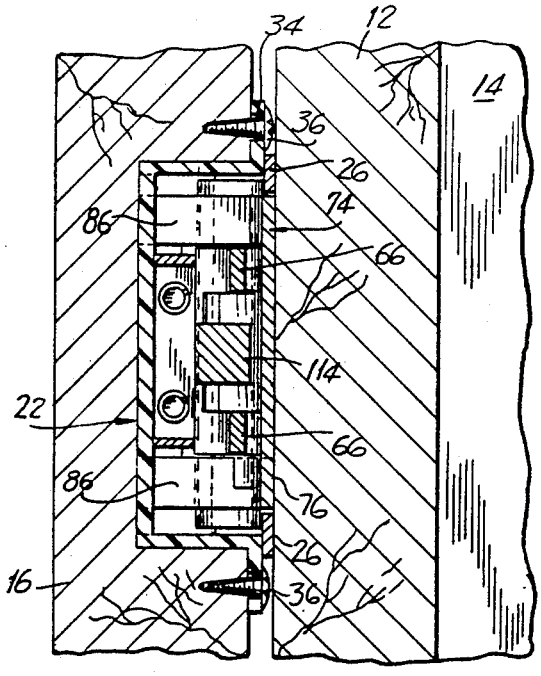
FIG. 16
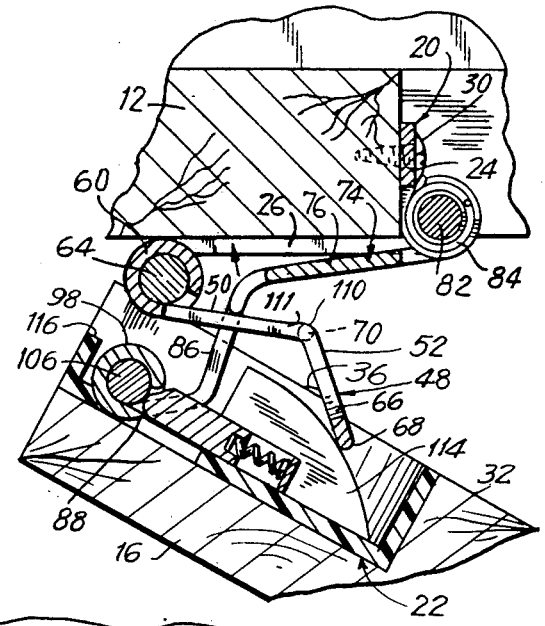
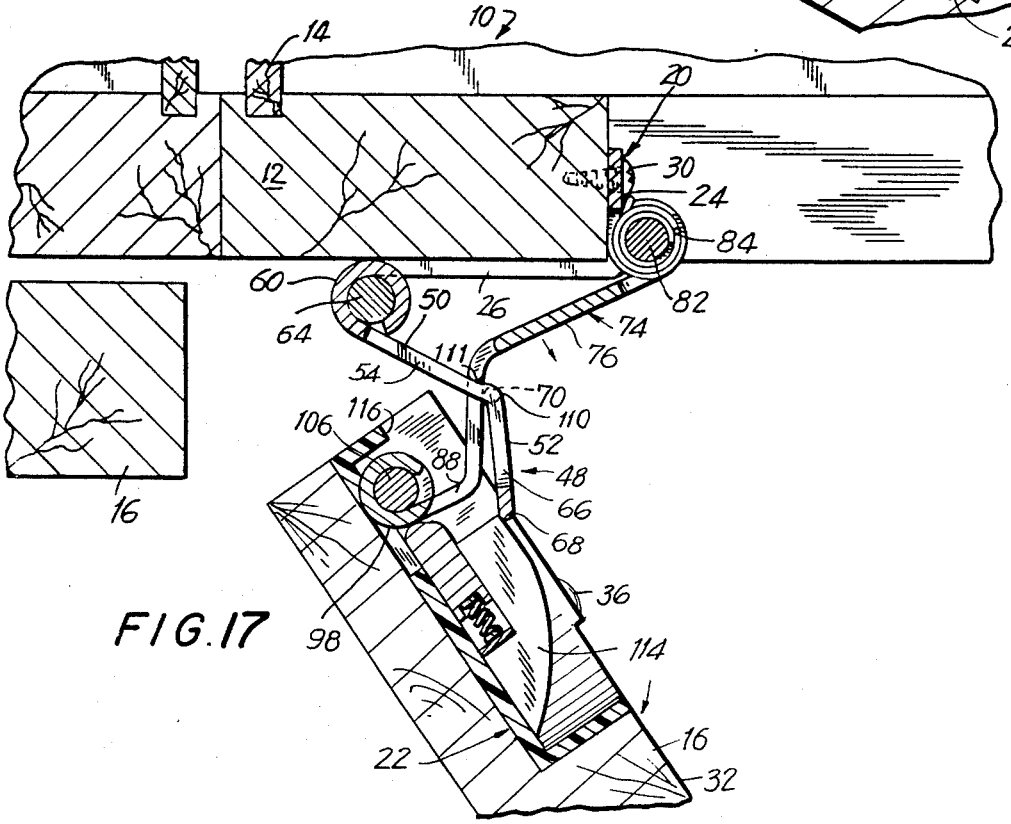
FIG. 17

CONCEALED DOOR HINGE

This application is a CIP of Ser. No. 131,487 filed 3/13/80 and a CIP of Ser. No. 93,448 filed 11/13/79, abandoned.

FIELD OF THE INVENTION

This invention pertains to concealed hinges for use on doors for cabinets, safes, vehicles and other similar structures. Specifically, the disclosed hinges are useful on face framed cabinets that are placed very close together or where there is a limited amount of space between the door edge and the cabinet frame as in a recessed door cabinet and wherever it is desirable to provide a concealed hinge or a door that may be opened more than 90° as on vehicles and safes.

Closely positioned cabinets are economically more feasible and both these and recessed door cabinets are aesthetically more pleasing. Concealed hinges are not only aesthetically pleasing but safer from a security point of view in that there are no exposed hinge elements which are vulnerable to tampering.

DESCRIPTION OF THE PRIOR ART

Holmes (U.S. Pat. No. 4,083,082) discloses one possible solution for providing a concealed self-closing hinge for cabinet doors. What is disclosed is a hinge unit known as a "quadrilateral" hinge. A hinge leaf is positioned on one of the vertical side walls of the cabinet and on the inner side surface of the cabinet door. Two links are used to complete the quadrilateral system. Each link has one end accommodated in a trough in the cabinet door. The inner link has its other end pivotally connected to a protuberance on the vertical wall of the cabinet. The outer link has its other end positioned at another point in the recess of the cabinet door. Thus, the links serve as opposite sides of the quadrilateral, and the two leaves serve as the other opposite sides of the quadrilateral. Therefore, the course of movement of the door is determined by the geometry of the quadrilateral.

One of the disadvantages to using the above-described quadrilateral hinge is that it is very cumbersome and difficult to operate. Another problem with the device is that it is very expensive and very sensitive. If the pin used to mount the inner link on the protuberance of the inner wall of the cabinet is not exactly aligned, the device will not operate properly and it will not become possible to open the door. Furthermore, this hinge does not permit opening of the door beyond 90°, and it does not work on face framed cabinets.

Zernig (U.S. Pat. No. 3,952,368) discloses a scissor-type hinge for use on open type cabinets only. While it may be used when it is necessary to insure that the door can rotate or open by more than 90°, it is very expensive and it is not suitable for use on face framed cabinets.

Salice (U.S. Pat. No. 3,864,786) discloses a self-closing pivotal joint with a concealed hinge. This invention is not concerned so much with providing a hinge for completely opening the door, but rather is concerned with a device that will automatically completely close the door when it is left slightly ajar. Further, the hinge structure disclosed is extremely complicated and, consequently, very expensive.

Anderson (U.S. Pat. No. 3,835,585) discloses a self-closing hinge, which is concealed. One of the disadvantages of this hinge is that it is not suitable for use where cabinets are placed close together. Because of the construction of the hinge, the door would necessarily come up against an adjacent cabinet door if the doors were placed too close together.

The cabinet hinge disclosed by Pittasch (U.S. Pat. No. 4,099,293) is not suitable for use on cabinets positioned close together. This is because the hinge disclosed requires a relatively large amount of room in which to open and, if the cabinet doors were positioned too close together, they would necessarily hit each other when one of the doors was opened.

Lautenschlager (U.S. Pat. No. 4,091,500) discloses still another type of cabinet hinge. Though this device is supposedly simple to install, it is a very complicated device. Moreover, it appears from the disclosure that the device cannot be used on cabinets which are positioned very close together.

SUMMARY OF THE INVENTION

A primary purpose of this invention is to provide a concealed hinge which permits the opening of a door much beyond the usual 90° and which may be particularly useful on recessed door cabinets or on closely spaced cabinets where there is little space between the cabinet wall and the door edge or between adjacent door edges. For example, where it is desired to position a plurality of cabinets closely together, even if there is some space between the cabinets, the door of a face framed cabinet, or a door mounted externally of an open type cabinet, may not ordinarily be opened beyond an approximate 90° because the hinge side of the door will come against the face frame, or an adjacent door, as the case may be, when in the fully opened position. Thus, another object of this invention is to provide a hinge which will serve to displace the door from the cabinet, so as to permit the opening of the door up to an approximate 180° and, where desired, even beyond. In the case of recessed door cabinets, the door will ordinarily not be capable of opening beyond 90°, because it will strike against the side of the cabinet. The hinge of this invention will now permit the opening of such a cabinet door up to an approximate 180°, because the door will be displaced from its recess within the cabinet and thus will be able to open without striking the side of the cabinet. A further object of this invention is to provide a hinge which will require little or no space between adjacent door edges and will permit the opening of a cabinet door up to an approximate 180° even where the cabinets are in abutting relationship.

In the case of face framed cabinets mounted in close juxtaposition, it has been found that for door thicknesses up to 9/16", the doors may be in abutting relationship and nevertheless be opened a full 180° so that one door overlies the next adjacent door. As the thickness of the door increases over 9/16", there may be a limitation in that the door may open no more than about 140°. If it is desirable to have the door open beyond 140°, then some space between adjacent door edges should be provided. For example, for a ¾" door, if a ¼" space between door edges is provided, the doors may be opened an approximate 155°. In other words, the invention permits the opening of doors well beyond 90° even where the door edges are in touching relationship regardless of the thickness of the doors because the hinge of this invention serves to move the door away from the adjacent door edge and permits it to swing out as far as possible, limited only by the positioning of the adjacent cabinet and door.

Moreover, if the hinge of this invention is properly scaled down in size, it can be used as a hinge for micro-sized cabinet doors, in which event the door thickness may be of less concern than above noted. In constructing the hinge of this invention, the important thing that must be maintained is the relative positioning of the hinge members. If these relationships are maintained, the hinge can operate for any given size.

The principles underlying the operation of this invention are quite different than the principles of operation of the prior art devices. This new and novel hinge has basically three pivot points, all of which are hidden when the door is closed. In some embodiments of the invention, the first pivot may be positioned in a slide so that it moves as the hinge operates. In opening operation, the hinge serves to first displace the door from the cabinet and then rotate it to an open position, thus providing accessibility to the interior of the cabinet. In closing operation, a forcing member moves the hinge elements toward the cabinet. In one embodiment, a cam positioned on the door urges the forcing member to move the hinge elements toward the cabinet. In another embodiment, the end of the forcing member is positioned in a slide on the door and, as the forcing member moves, it closes the hinge.

If desired, the hinge of this invention may be used for many applications other than for cabinet doors such as on safe and automobile doors. Since the hinge of this invention is concealed when the door is closed, it will be very useful where it is desirable to conceal the hinge to prevent forced entry. Also, in the case of automobile car doors, it will be possible to eliminate the otherwise very big, bulky and unsightly hinges. These are only two other applications for the hinge of this invention, but is must be remembered that there may be many other uses for the hinge of this invention. In addition, when used in face frame cabinets, the hinge of this invention takes up very little room and permits the entire interior surface of the cabinet to be used for storage. Thus, the hinge of this invention is a substantial improvement over the prior art hinges which take up a portion of the room inside the cabinet.

BRIEF DESCRIPTION OF THE DRAWINGS

FIG. 3 is a view taken substantially along the lines 3—3 of FIG. 2 and showing the door in the fully closed position;

FIG. 4 is a view similar to FIG. 2, but showing the door in the partially opened position at that point where the movement of the door away from the cabinet is at its outermost position and limited by the stop pin which is an integral part of one of the hinge members;

FIG. 7 is a view similar to FIGS. 2, 4 and 5, but showing the door in an almost fully closed position;

FIG. 15 is a view taken substantially along the lines 3—3 of FIG. 14 and showing the door in the fully closed position;

FIG. 16 is a view similar to FIG. 14, but showing the door in the fully opened position at the point where the movement of the door away from the cabin is at its outermost position and limited by the stop pin which is an integral part of one of the hinge members;

FIG. 17 is a view similar to FIG. 16, but showing the door in a nearly fully opened position with the built-in stop member almost abutting the other hinge member;

DETAILED DESCRIPTION OF THE INVENTION

Figure 1:
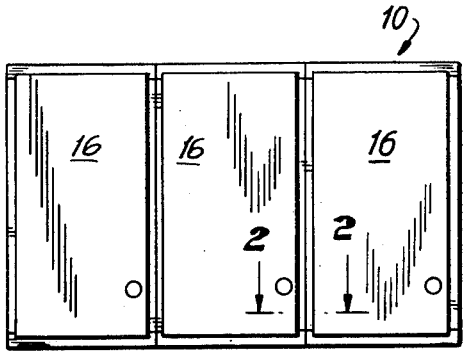
FIG. 1 is a front elevational view showing a group of cabinets in side-by-side relationship to illustrate their proximity.

FIG. 1 shows a plurality of face framed cabinets 10, in abutting relationship with adjacent door edges spaced a small distance apart. In the preferred embodiments where the cabinet and door are made of wood, the thickness of the door should be at least 7/16" in order to provide room for the hinge within the door. If the thickness of the door is about 7/16" or ½", adjacent door edges may be abutting or as close as ⅛" apart.

In the embodiment of the hinge shown in FIGS. 2–8, the hinge is made so as to be mountable on and useable with a cabinet with a face frame. A face frame 12 is mounted to the open side of the cabinet, as by securing it in some manner to the side panels 14 of the cabinet. The construction of cabinets having face frames is well known and such cabinets are frequently used all over the country. A door 16 is mounted on the face frame 12 of each cabinet 10 in order to provide a cover for the interior of the cabinet. In most instances, the cabinet and the door will be made of the same material, such as wood or similar materials. In some cases, however, it may be desirable to make one or the other out of a different material. In any case, the hinge of this invention will be useable with a cabinet and door made out of any conventional materials suitable for such cabinets and doors.

The hinge of this invention can be made from any material suitable for hinges. In the preferred embodiments, the hinge is generally made of a combination of metal and hard plastic.

Figure 6:
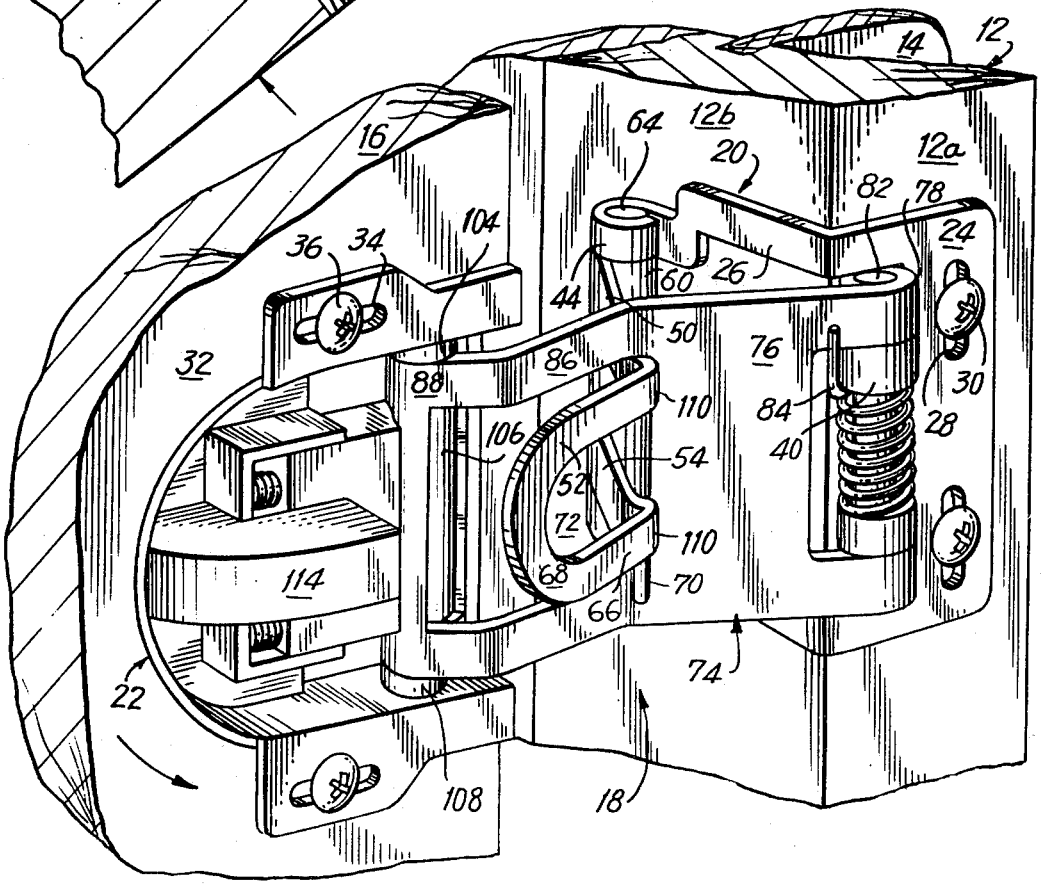
FIG. 6 is an enlarged perspective view showing the hinge elements in their relative positions as the door is being closed.
Figure 8:
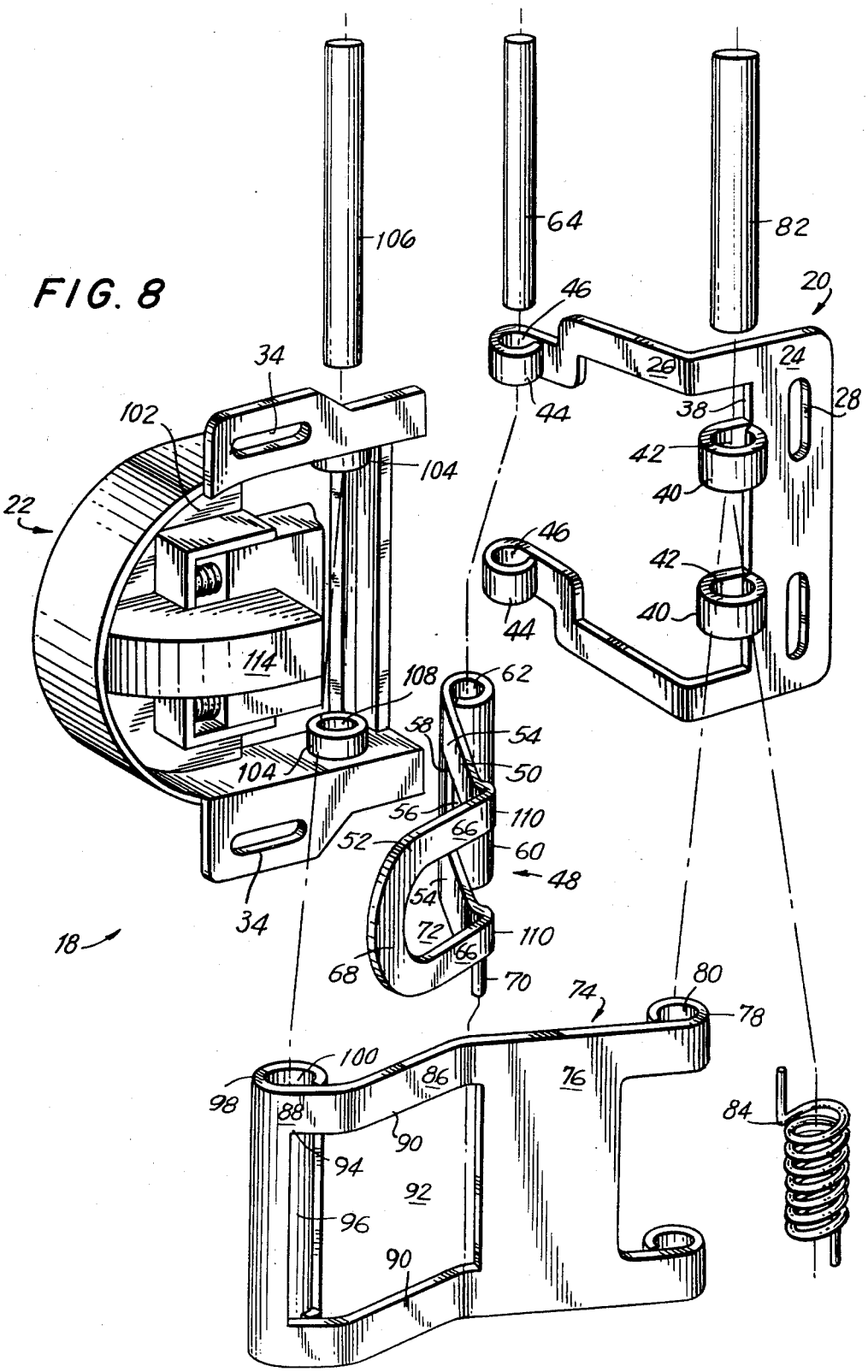
FIG. 8 is an enlarged, exploded view showing the elements that constitute the hinge of this invention.

The hinge 18 of this invention is operatively associated with the face frame 12 of the cabinet and the door 16 of the cabinet. Included in the hinge means 18 are two leaves 20 and 22. As best seen in FIGS. 6 and 8, the interior leaf 20 has a side face 24 and a front face 26, which are substantially perpendicular to each other for positioning on the inside edge 12*a* and the outside surface 12*b*, respectively, of the face frame 12. In the preferred embodiment, these two faces should preferably be made integral into a single substantially right angle leaf 20. The leaf 20 may be secured to the inside edge 12*a* and/or the outside surface 12*b* of the face frame 12 by means of bolts or screws 30 or other suitable fastening means passing through openings 28 in the side face 24 and/or the front face 26. If an appropriate number of screws 30 are used, it may not be necessary to provide fastening means on one of the faces. The external leaf 22, cup-like in shape, is attached to an inner surface 32 of the door 16. As with the interior leaf 20, the cup-like leaf 22 may be secured to the inner surface 32 of door 16 by screws or bolts 36 passing through the openings 34. Alternatively, the leaves 20 and 22 may be attached by other suitable fastening means such as adhesives or the like.

Referring now to FIG. 8, provided on a front edge 38 of the side face 24 of the leaf 20 are circular retaining members 40 with an interior opening 42, such structures commonly being referred to in the art as a "curl." Curls 44 are also provided on the end of the front face 26 away from the side face 24. Each of these curls 44 is also provided with a central opening 46.

Also included in the hinge 18 is a forcing member 48. This member 48 includes inner and outer sections 50 and 52. The inner section 50 includes two substantially parallel legs 54 which define an opening 56 between them. Along one end the legs 54 are connected by a third leg 58. The leg 58 is fashioned so that it includes a relatively long or longitudinal curl 60 with a central opening or channel 62. The preferred length of the curl 60 is approximately equal to the distance between the curls 44 positioned on the end of the front face 26 of the leaf 20. When the hinge is assembled, the curl 60 is positioned between the curls 44 and a pin 64 is passed through the openings 46 and 62 to define a first pivot. Thus, as is true of a typical hinge, the forcing member 48 will be retained in pivotal relationship with the leaf 20.

The outer section 52 of the forcing member 48 includes two legs 66 which are substantially parallel to each other and which define an opening 72 between them. A substantially arcuate leg 68 connects the distal portions of the legs 66. The other ends of the legs 66 are made integral with the outer ends of the legs 54 of the inner section 50 and may be at an angle to them. Extending outward from the lower leg 66, at its junction with the corresponding leg 54, a stop pin 70 may be provided.

The last of the four basic elements of the hinge 18 is the pivoting member 74. This member includes an inner portion 76 which interacts with the forcing member 48 (this interaction being described in a later portion of this description). The inner portion 76 is essentially a solid piece and has curls 78 provided on its innermost end. The curls 78 are spaced so that the curls 40 of the side face 24 of the leaf 20 may be positioned between them. When assembling the hinge (See FIG. 6), the curls 78 are positioned above and below respective curls 40. Then, a pin 82 is inserted through the openings 80 in the curls 78 and through the openings 42 in the curls 40 to define a second pivot. Thus, the hinge is assembled in a somewhat conventional manner. A coil spring 84 may be provided around the pin 82 between the curls 40. This spring exerts a force which generally forces the hinge into an open position.

The pivoting member 74 also includes middle and end portions 86 and 88. The middle portion 86 is comprised of substantially parallel legs 90, which are spaced apart by an opening 92. In the preferred embodiment, the legs 90 angularly extend from the bottom and top surfaces of the inner portion 76, respectively. When the hinge is assembled (see FIG. 6), the forcing member 48 will be disposed in the opening 92 of the pivoting member 74. The outer section 52 with the stop pin 70 will be positioned on the side of the pivoting member 74 opposite the curls 78. Thus, the inner section 50 of the forcing member 48 would necessarily lie on the side of the opening 92 on which the curls 78 are positioned.

The end portion 88 of the pivoting member 74 includes legs 94 connected to respective legs 90. The legs 94 are spaced apart by an opening 96, which is continuous with the opening 92. In the preferred embodiment, the legs 94 are fixed at an angle to the legs 90. The distal end portion of the end portion 88 is formed into a longitudinal curl 98 with a central opening or passage 100.

Though an attempt has been made in this specification to describe the forcing member 48 and the pivoting member 74. It is believed that a visual inspection of these two elements, as shown in FIG. 8, will be more helpful in understanding how these two elements are actually constructed. FIG. 6 provides a clear illustration of the manner in which these two elements are interconnected.

The leaf 22 is made as a cup-like structure, as is clearly shown in FIG. 8. A recessed area 102 is provided in the leaf 22. Two curl-like structures 104 are provided in the recessed area 102. When the hinge is assembled, the longitudinal curl 98 of the pivoting member 74 is positioned between the curls 104. To secure the leaf 22 and the pivoting member 74 together, a pin 106 is passed through the openings 108 of the curls 104 and through the opening 100 of the curl 98, as is commonly done in hinge structures, to define a third pivot.

Any conventional self-closing biasing means 103 may be included in the recessed area 102 of the leaf 22 to automatically close the door when it is left slightly ajar, such as the one disclosed by Anderson (U.S. Pat. No. 3,835,585).

Figure 2:
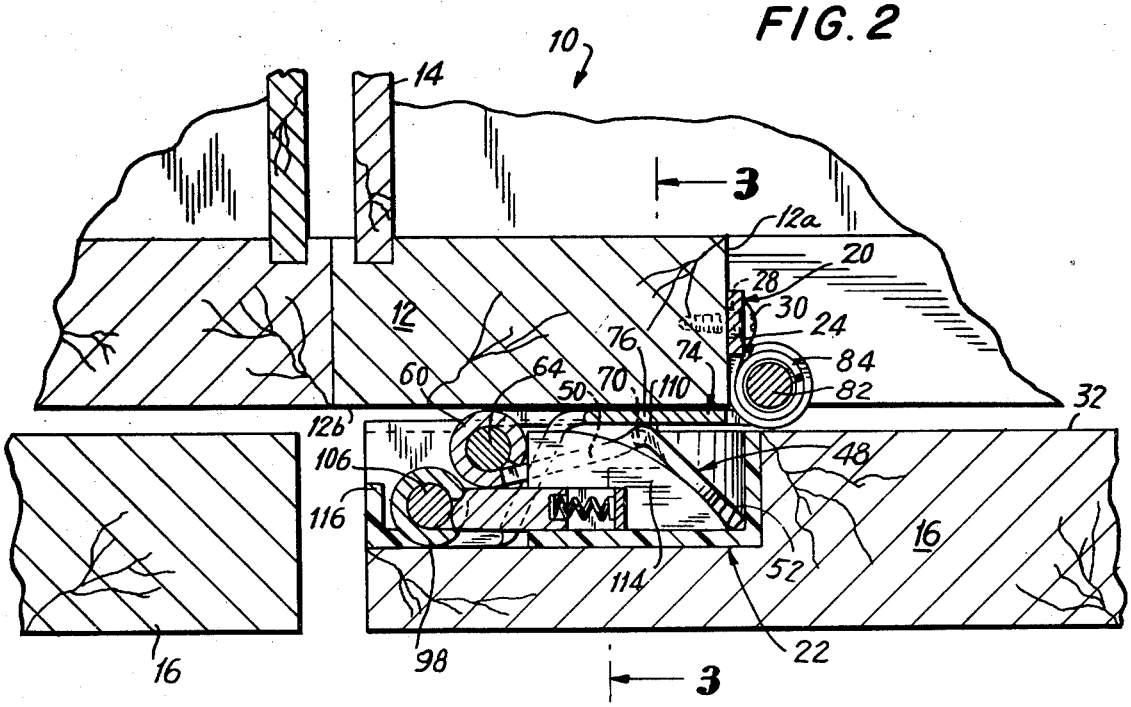
FIG. 2 is a view taken substantially along the lines 2—2 of FIG. 1 and showing a section through the approximate longitudinal middle of a hinge with the door in the fully closed position, each of the cabinets having a face frame.
Figure 5:
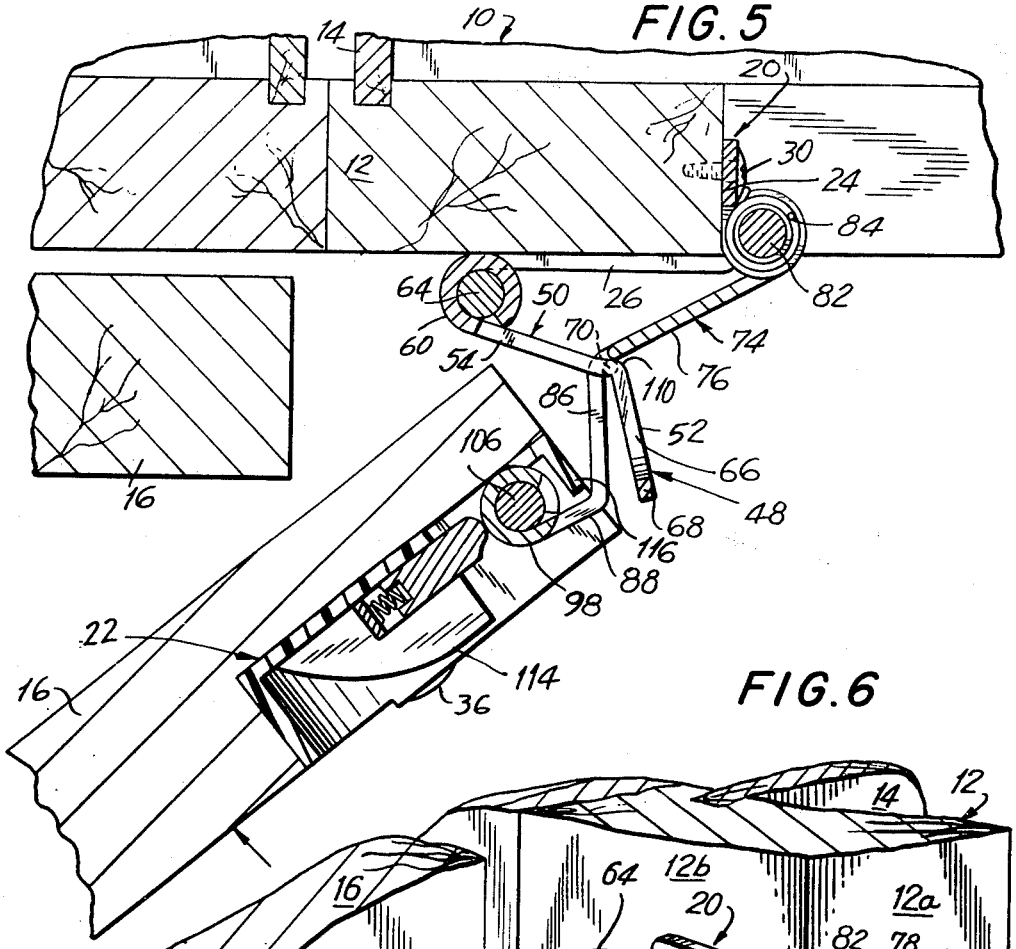
FIG. 5 is a view similar to FIG. 4, but showing the door in a near fully opened position with the built-in stop member almost abutting the other hinge member.

FIGS. 2 and 3 show the relative positioning of the various elements of the hinge when the door is in the fully closed position. The rounded points 110, where the legs 54 and 66 come together, are the only portions of the forcing member 48 which may be in contact with the inner portion 76 of the pivoting member 74.

The first step in opening the closed door is to grab the under surface of the door 16 and pull it away from the cabinet 10. The spring 84 will now force the rounded connecting points 110 to slide along the inner portion 76 of the pivoting member 74 until the stop pin 70 engages a concave stopping region 112, fashioned at the interconnection of the inner and middle portions 76 and 86 of the pivoting member 74 (see FIG. 4). Then, the door is rotated about the hinge pin 106 until the door has been opened to an angle of about 150° to 180° to the face frame 12 of the cabinet. If desired, a stop means 116 can be provided to limit the amount of opening of the door (see FIG. 5). Such a stop means would interact with the end portion 88 of the pivoting member 74 and prevent further rotation of the door 16. The amount of opening of the door can be varied by varying the size of the stop means 116. Any other type of stop means may also be used to limit the opening of the door. Now, as the door has been moved away from the cabinet, there is ample access to the interior region of the cabinet (see FIG. 5).

Because this unique hinge structure first moves the door outward from the cabinet, as the door is rotated open, the door will not strike or hit against the doors of adjacent cabinets. Further, because of the unique structures, when the door is in the closed position, the various hinge elements may remain concealed within the recess 102 of the external leaf 22. Thus, it is possible to obtain a unique concealed hinge for closely spaced cabinet doors. Hence, cabinets can be designed to obtain the maximum aesthetic effect without the need for worrying about the unsightly appearance of hinges.

To close the door, one first rotates the door from its open position (shown in FIG. 5) until the door is substantially parallel to the outside surface of the face frame of the cabinet. At this point, the arcuate leg 68 of the forcing member 48 will come into contact with a cam-like structure 114 made in the recessed area 102 of the leaf 22. As the arcuate leg 68 slides along the surface of the cam 114, the rounded shoulders 111 will move along the inner portion 76 of the pivoting member 74.

As is clearly shown in FIGS. 2 and 8, the front face 26 of the leaf 20 is designed so that the inner portion 76 of the pivoting member 74 may be positioned therein when the door is in the fully closed position. Further, the recessed area 102 of the leaf 22 is designed so that the remaining portions of the pivoting member 74 may fit thereinto when the door is in the fully closed position. Thus, the door may be closed to a point very near the face frame of the cabinet without any unsightly hinge elements being visible.

It will now be appreciated that the hinge of this invention may be used on doors of varying thicknesses regardless of the space between the edges of adjacent doors and on cabinets mounted in abutting relationship and nevertheless facilitate the opening of a door to an approximate 150° or 180° from the plane of the face frame.

Figure 10:
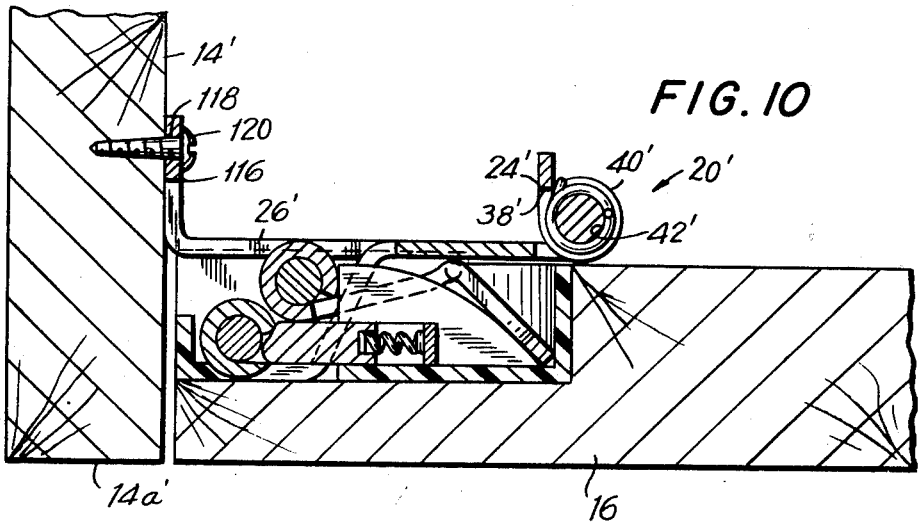
FIG. 10 is a view substantially similar to FIG. 2, but using the hinge member shown in FIG. 9 and where the door is mounted internally of the cabinet without the benefit of a face frame.
Figure 11:
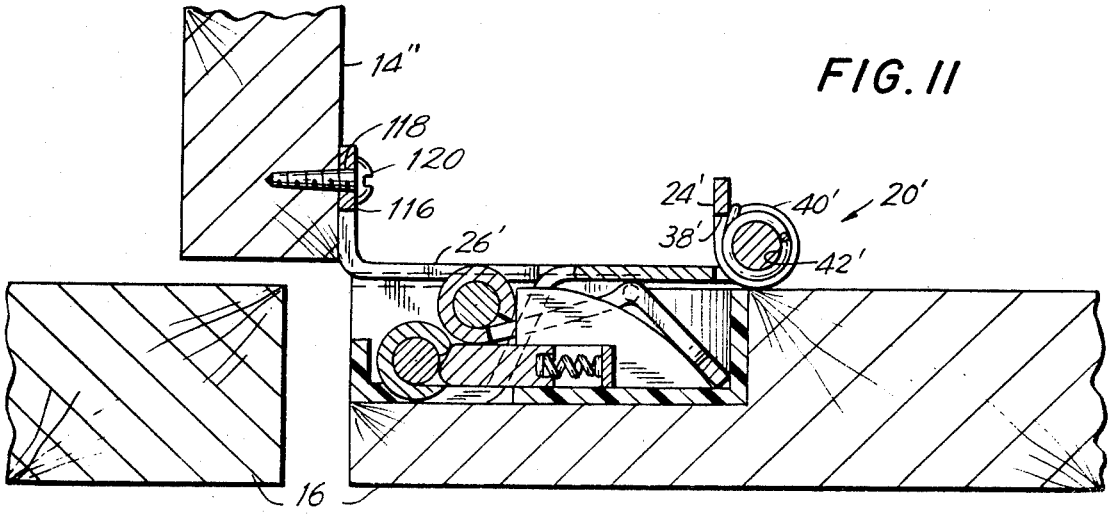
FIG. 11 is a view similar to that of FIG. 10, except that the door is mounted externally of the cabinet without a face frame.

The instant invention may also be used on cabinets which do not have face frames. For instance, as is shown in FIG. 10, the hinge of this invention may be used on a cabinet without a face frame, where the door is mounted internally of the outer edge of the side panel of the cabinet. As shown in FIG. 11, the hinge of this invention may also be used on a cabinet without a face frame, where the door is mounted externally of the outer edge of the side panel of the cabinet. In each of these embodiments only the interior leaf 20 has to be modified. All of the other elements of the hinge would be constructed in the same manner as for the hinge used in conjunction with a face framed cabinet.

Figure 9:
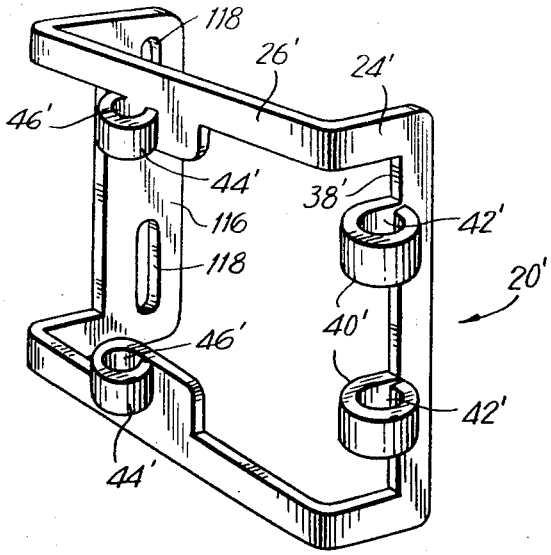
FIG. 9 is an enlarged perspective view of another embodiment of the interior leaf which is mounted on the cabinet.

In FIG. 9, the modified interior leaf 20' is shown. Extending outward from the front edge 38' of the side face 24' are two curls 40', each having a central opening 42'. Two curls 44' are fashioned along the front face 26' of the interior leaf 20', each curl having a central opening 46'. Together with the curls of the forcing member and the pivoting member and the pins 64 and 82, the curls 44' and 40' define the first and second pivots, respectively. Further, a tangent to the extreme point on the periphery of the curls 40' should lie in substantially the same plane as the front face 26'.

The interior leaf 20' is also provided with a mounting face 116 extending substantially perpendicularly to the front face 26'. One or more openings 118 may be provided in the mounting face 116. Screws or bolts 120, or other suitable means, may be passed through these openings 118 to secure the interior leaf 20' to the side panel 14' of the cabinet. Alternatively, any other suitable means, such as adhesives, may be used to attach the interior leaf 20' to the side panel 14' of the cabinet.

In the case of the embodiment shown in FIG. 10, the hinge permits the door 16 to be pulled sufficiently away from the cabinet so that it will clear the front edge 14a' of the side panel 14' when the door is opened. In operation, the hinge disclosed in FIG. 10 operates the same as the one shown in FIGS. 2–8.

As for the embodiment shown in FIG. 11, this hinge operates substantially the same as the one disclosed in FIGS. 2–8. The hinge of the invention permits the door 16 to be moved sufficiently outward so as to clear the adjacent door when the door is being opened.

Figure 12:
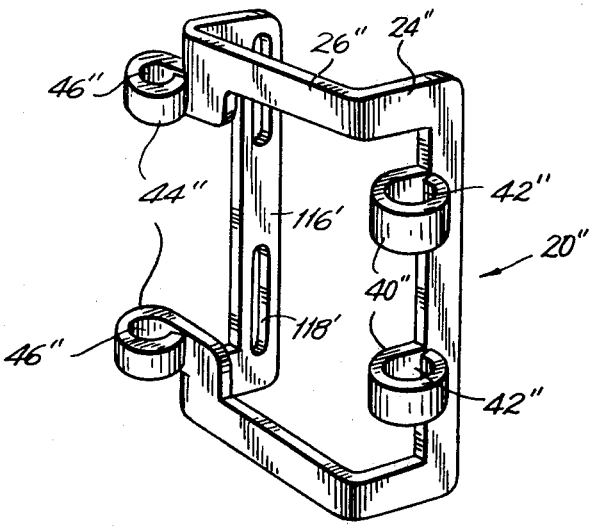
FIG. 12 is an enlarged perspective view of another embodiment of the interior leaf which is mounted on the cabinet.
Figure 13:
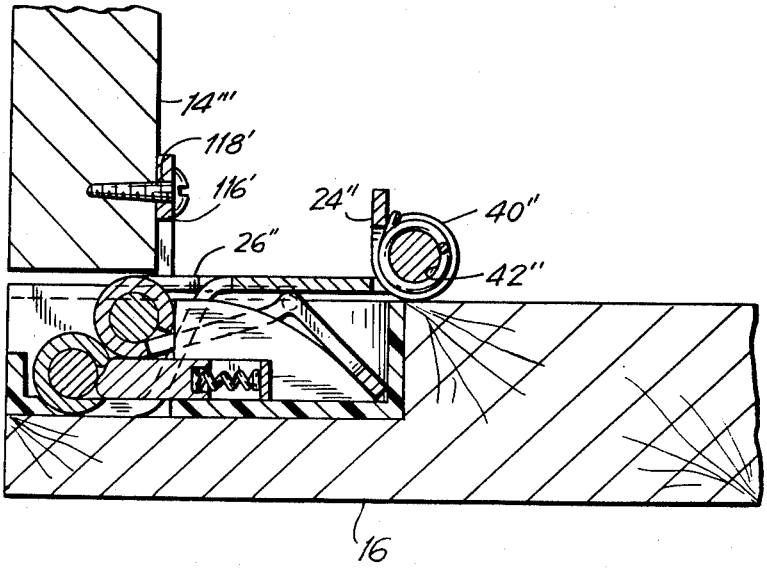
FIG. 13 is a view substantially similar to FIGS. 2, 10 and 11, but using the hinge member shown in FIG. 12 and where the door is mounted externally of the cabinet without a face frame.
Figure 14:
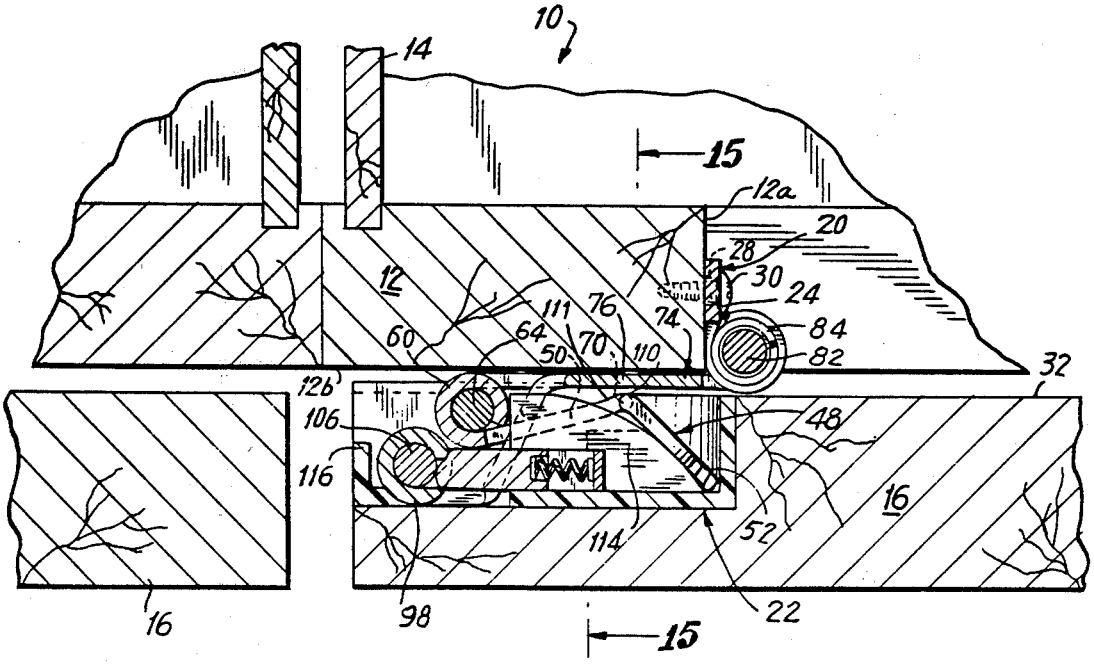
FIG. 14 shows a second embodiment of the invention and is a view taken substantially along the lines 2—2 of FIG. 1 and showing a section through the approximate longitudinal middle of a hinge with the door in the fully closed position, each of the cabinets having a face frame.
Figure 18:
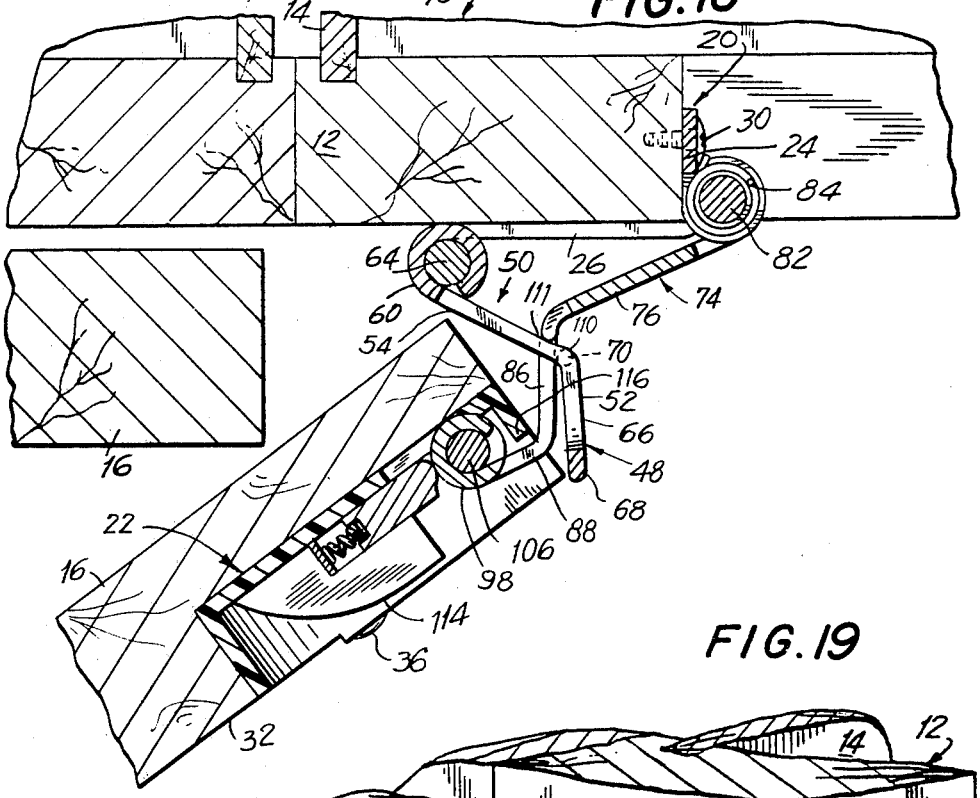
FIG. 18 is an enlarged perspective view, of the embodiment shown in FIG. 14, showing the hinge elements in their relative positions as the door is being closed.

FIG. 13 discloses the use of the hinge of this invention in a cabinet arrangement similar to that shown in FIG. 11. The basic difference in the two cabinet structures is that in FIG. 11 there is a common wall 14'' between adjacent cabinets. In FIG. 13 there are two separate walls 14''' for the adjacent cabinets. Therefore, in the embodiment shown in FIG. 13, the interior leaf 20'' shown in FIG. 12 is more desirable. In this embodiment, the curls 44'' are preferably mounted at the intersection of the front face 26'' and the mounting face 116'. In all other respects this embodiment of the hinge operates the same as the hinge shown in FIG. 11.

It must be appreciated that there are many variations that can be made to each of the elements of the hinge without departing from the main theme of the invention.

For instance, it is possible to construct the interior leaf of separate components. The hinge could operate if no interior leaf was provided, and the curls provided on said interior leaf were mounted directly on the inside edge and the outside surface of the face frame. Similarly, flat leaves on which the curls are provided could also be provided on each of these surfaces of the face frame. In fact, those skilled in the art could design many other ways of positioning the curls of the interior leaf in their proper relative positions. The only requirement that is important for the positioning of these curls is that it is preferable that a tangent drawn to the outermost point of the curls mounted in relation to the inside edge of the face frame be substantially in the same plane as a tangent drawn to the innermost portion of the curls mounted on the outside surface of the face frame.

Another possible variation of the invention is to form the pivoting member of separate components. For instance, the inner portion 76 and the middle portion 86 of the pivoting member 74 can be hinged together and made as separate elements. Other similar constructions of the pivoting member are possible, as long as such variations will permit the pivoting member to operate in accordance with the general principles of operation of the instant invention.

If the stop means 116 of the first embodiment of this invention is properly positioned, the door may be opened to the point just before it would touch the door of the adjacent cabinet. In such an instance the door may be opened to approximately 180°. In applications where there is no adjacent door or cabinet or on the rear door of a station wagon or van, the pivot points of the hinge may be adjusted so as to permit door opening to just beyond 180°.

FIGS. 14–22 illustrate a second embodiment of the invention (the same reference numerals have been used to indicate the same elements). The difference between the two embodiments is that in the embodiment of FIGS. 14–22 the rounded points 110 of the forcing member 48 do not contact the inner portion 76 of the pivoting member 74. Instead, the rounded points 110 are slightly spaced from the surface of the inner portion 76.

In the second embodiment of the invention, the middle portion 86 of the pivoting member 74 includes abutment portions 87. These abutment portions are essentially extensions of the inner portion 76 which extend outward from the inner portion 76 and from the legs 90 into the opening 92 between the legs 90. Forcing shoulders of the forcing member 48 are constructed so as to interact with respective abutment portions 87. This is achieved by constructing the legs 54 and 66 of the forcing member 48 so that they are joined at a rounded point 110. This connection will cause the forcing shoulders 111 to be defined between the legs 54 and the rounded points 110.

In opening a door which includes a hinge made according to the second embodiment, the operation of the hinge is substantially the same as for a hinge made according to the first embodiment.

Figure 19:
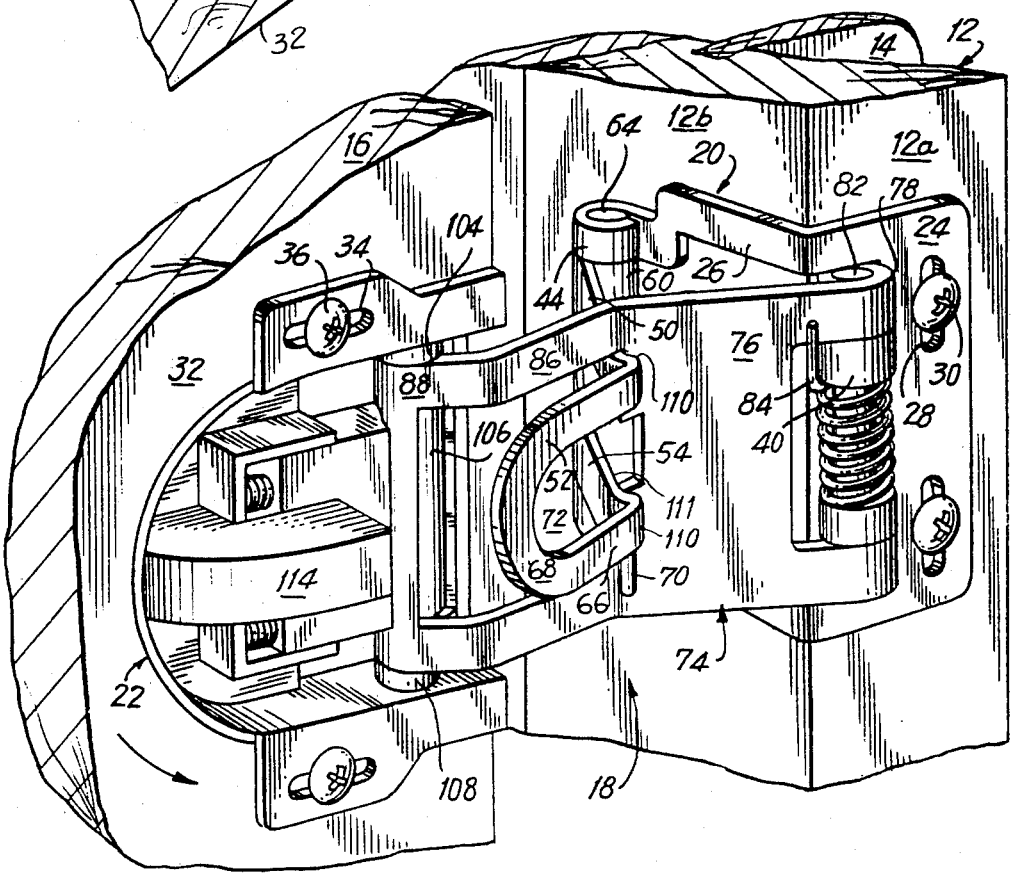
FIG. 19 is a view similar to FIGS. 14, 16, and 17, but showing the door in an almost fully closed position.
Figure 20:
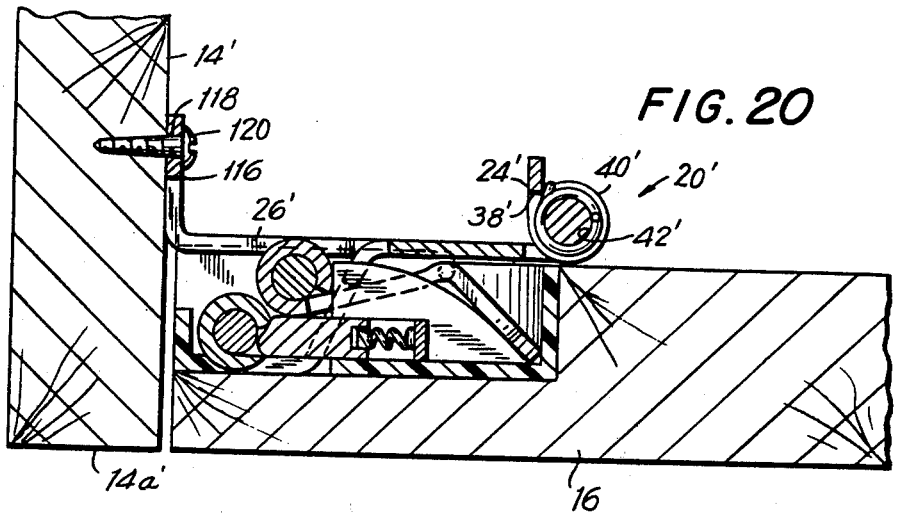
FIG. 20 is a view substantially similar to FIG. 14, but using the hinge member shown in FIG. 9 and where the door is mounted internally of the cabinet without the benefit of a face frame.
Figure 21:
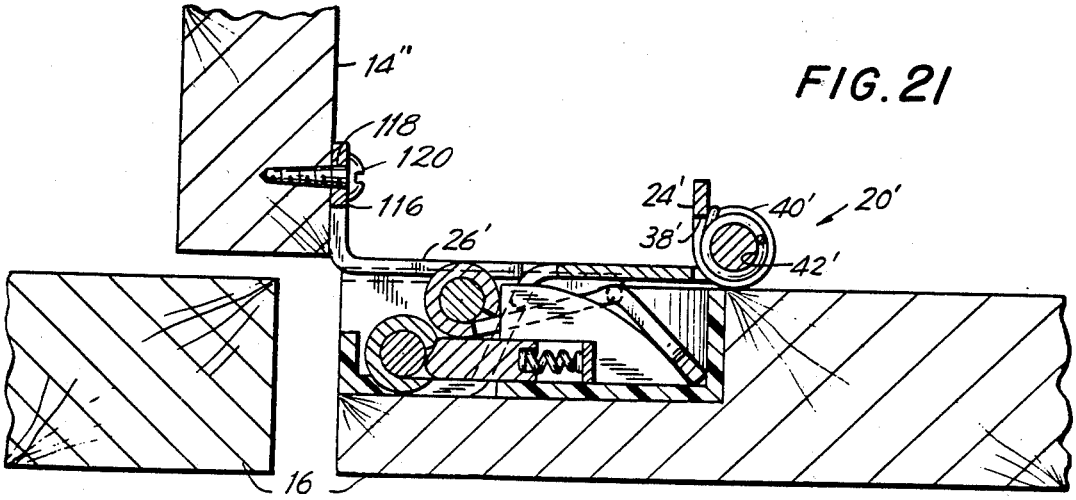
FIG. 21 is a view similar to that of FIG. 20, except that the door is mounted externally of the cabinet without a face frame.
Figure 22:
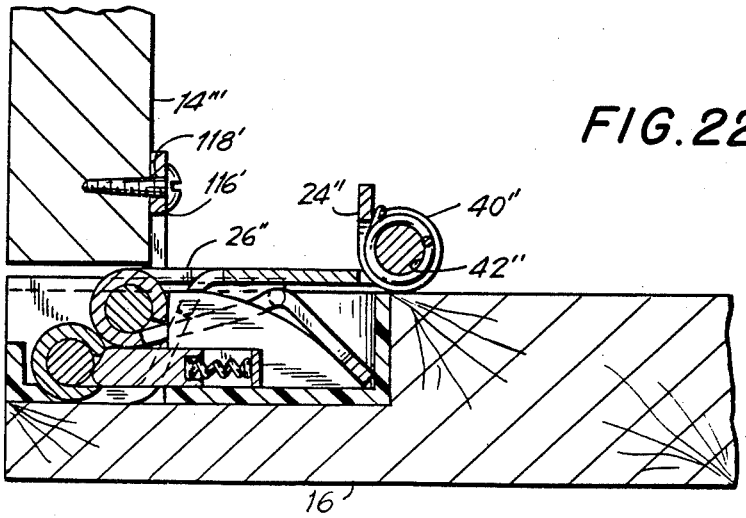
FIG. 22 is a view substantially similar to FIGS. 14, 20, and 21, but using the hinge member shown in FIG. 12 and where the door is mounted externally of the cabinet without a face frame.
Figure 33:
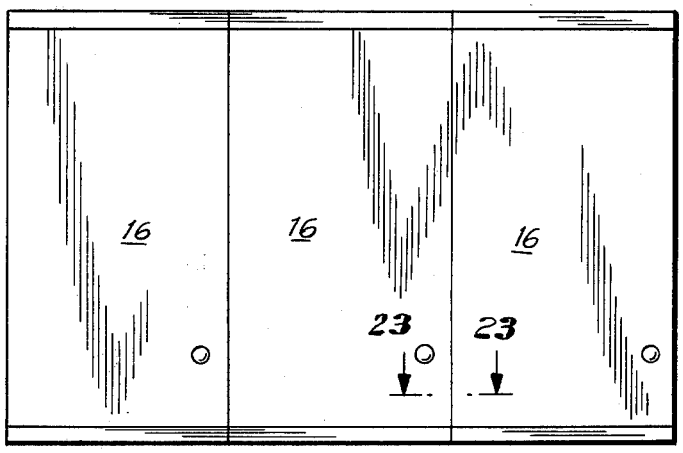
FIG. 33 is a front elevational view showing a group of cabinets in side by side relationship.
Figure 23:
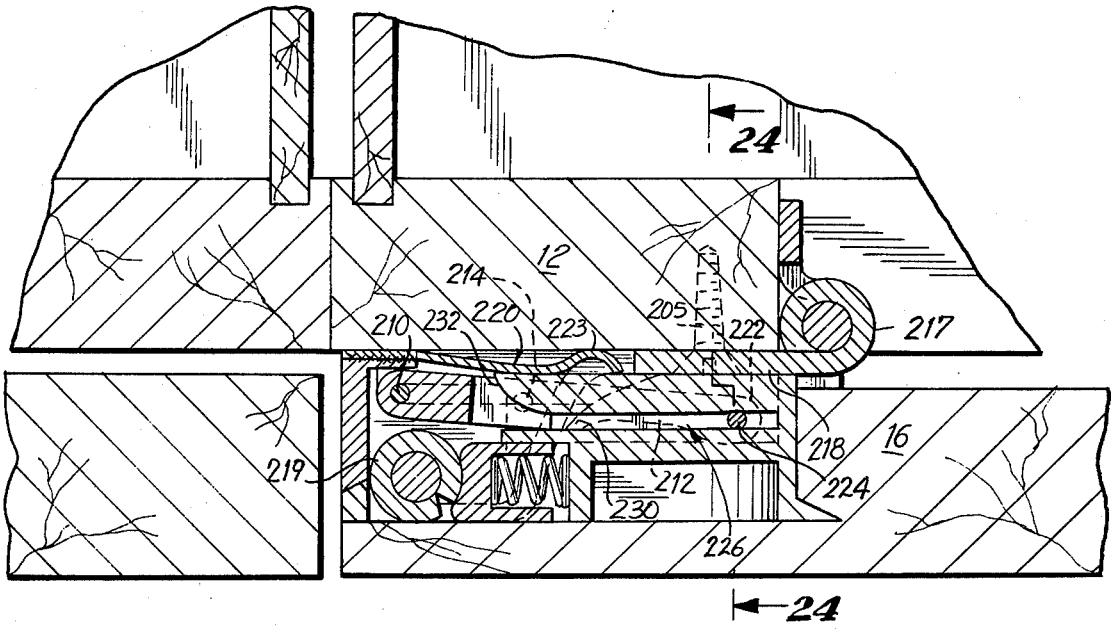
FIG. 23 shows a third possible embodiment of the invention and is a view taken substantially along the lines 2—2 of FIG. 1 and showing a section through the approximate longitudinal middle of a hinge with the door in the fully closed position, each of the cabinets having a face frame.
Figure 24:
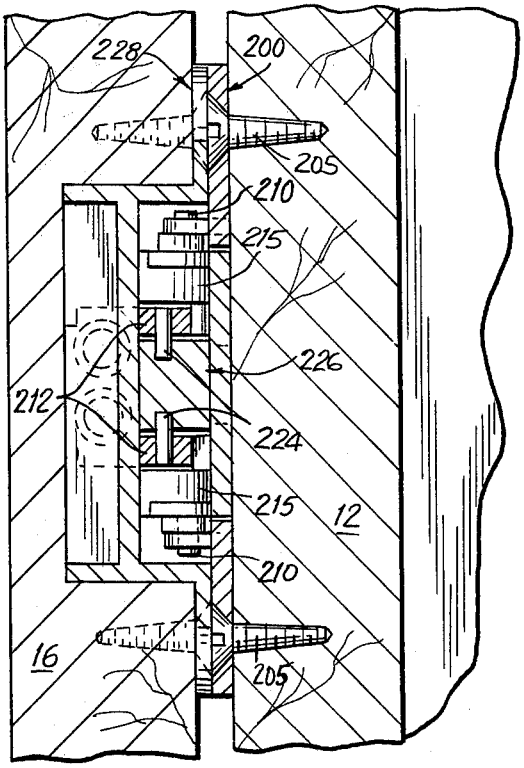
FIG. 24 is a view taken substantially along the lines 3—3 of FIG. 23 and showing the door in a fully closed position.
Figure 25:
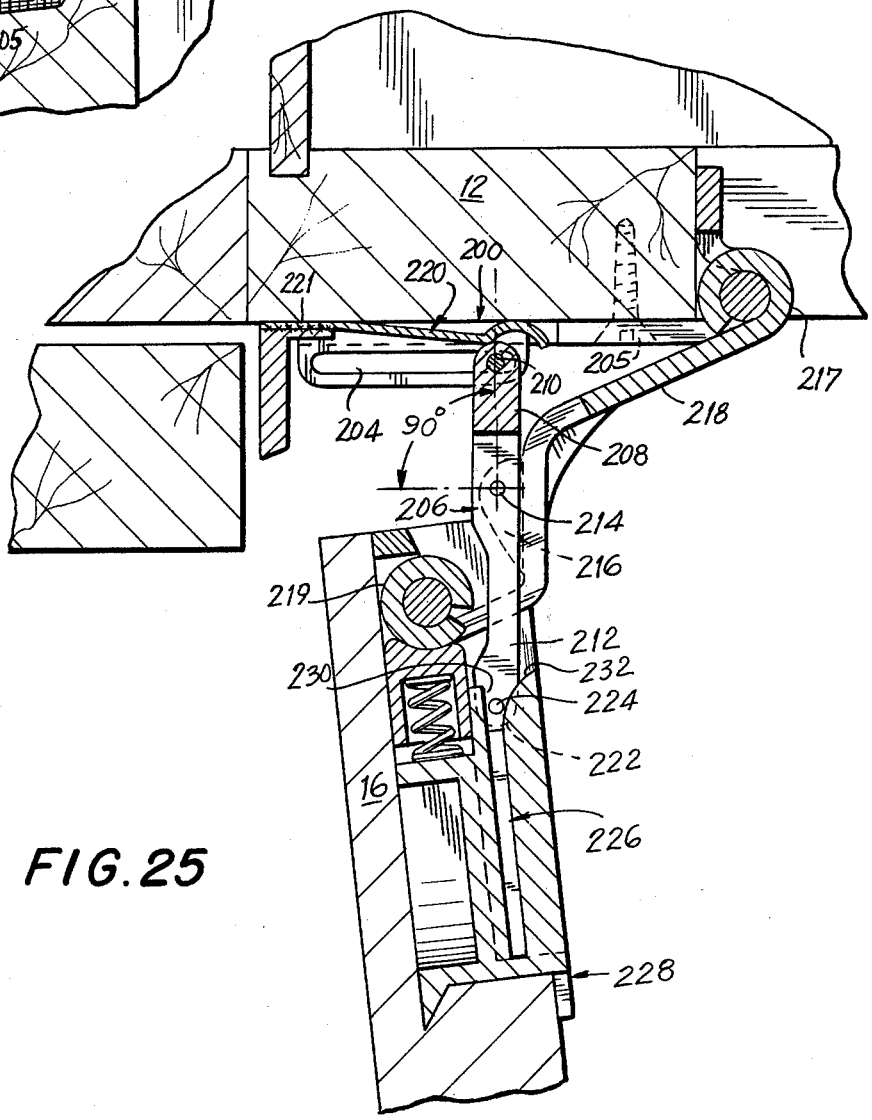
FIG. 25 is a view similar to FIG. 23, but showing the door in the partially opened position at that point where the movement of the door away from the cabinet is at its outermost position.
Figure 26:
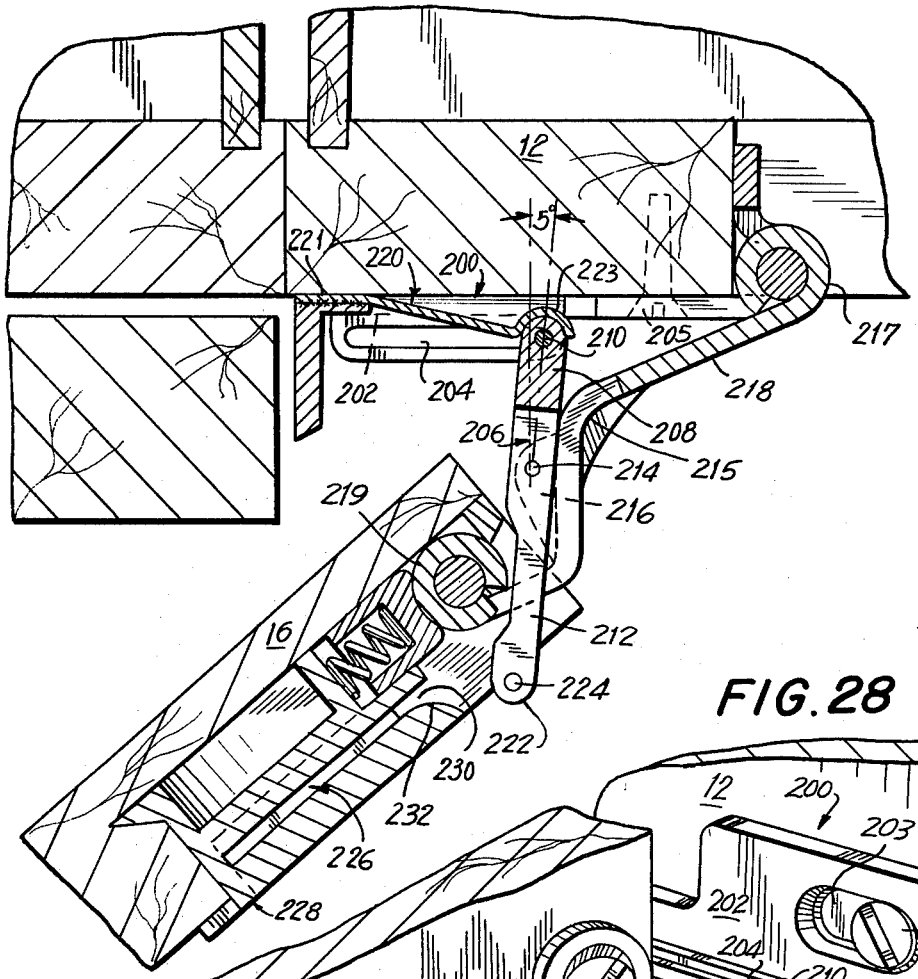
FIG. 26 is a view similar to FIG. 25, but showing the door in a near fully opened position with the built in stop member almost abutting the outer hinge member.

During the closing operation of a door which includes a hinge of the second embodiment, the operation is substantially the same, except that the forcing shoulders 111 will interact with the abutment portions 87 of the pivoting member 74 and cause the pivoting member 74 to be pushed back against the outside surface of the face frame of the cabinet (see FIG. 19).

In all other respects, the second embodiment of the invention is the same as the first embodiment. It should be pointed out that the invention will work just as satisfactorily when the rounded portions 110 are spaced from the inner portion 76 of the pivoting member 74, as it works when the rounded portions 110 are in actual contact with the inner portion 76.

FIGS. 23–32 show still another possible embodiment of the invention. In this embodiment, the first pivot is slidingly positioned within guides positioned on the inner leaf.

Figure 28:
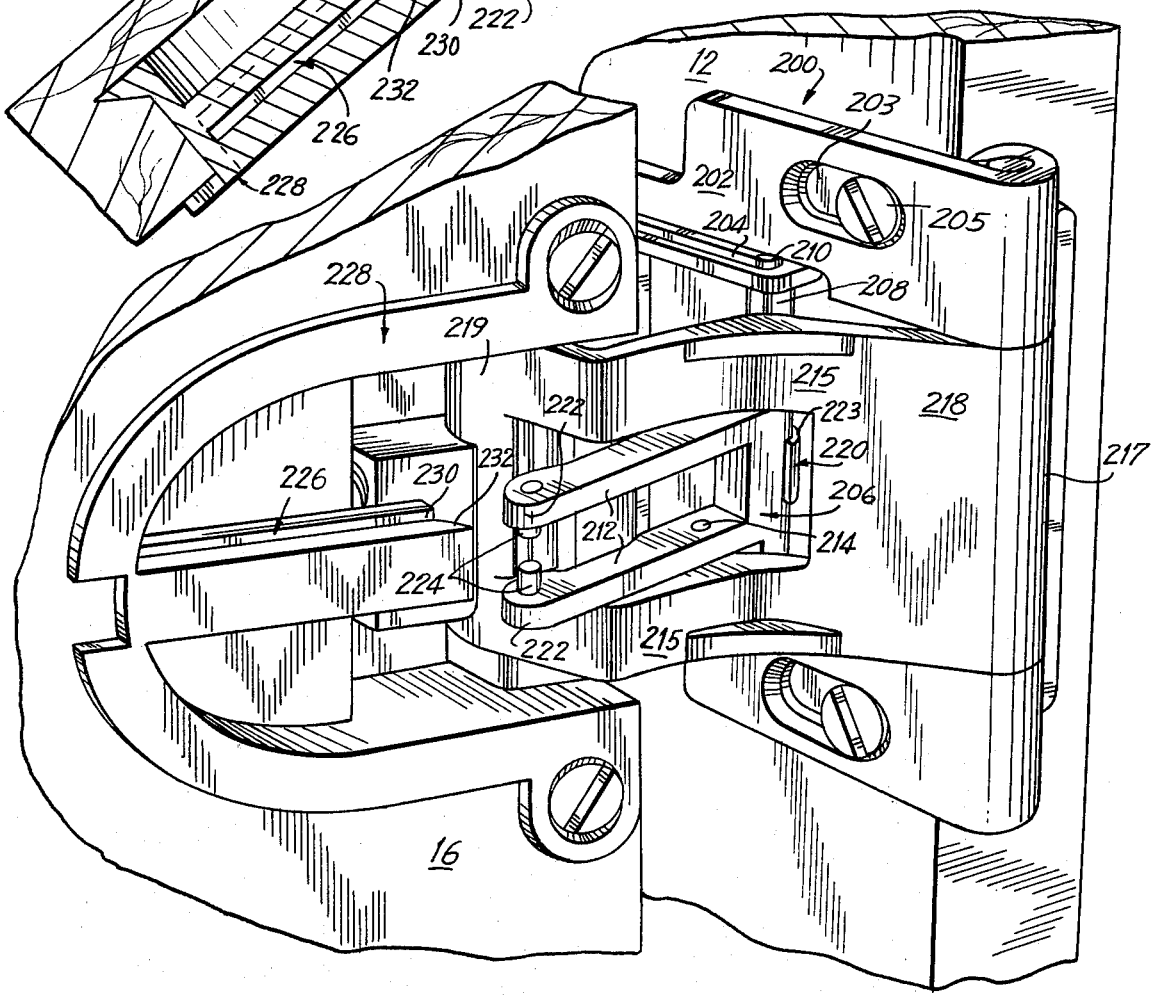
FIG. 28 is an enlarged perspective view, of the embodiment shown in FIG. 23, showing the hinge elements in their relative positions as the door is being closed.
Figure 29:
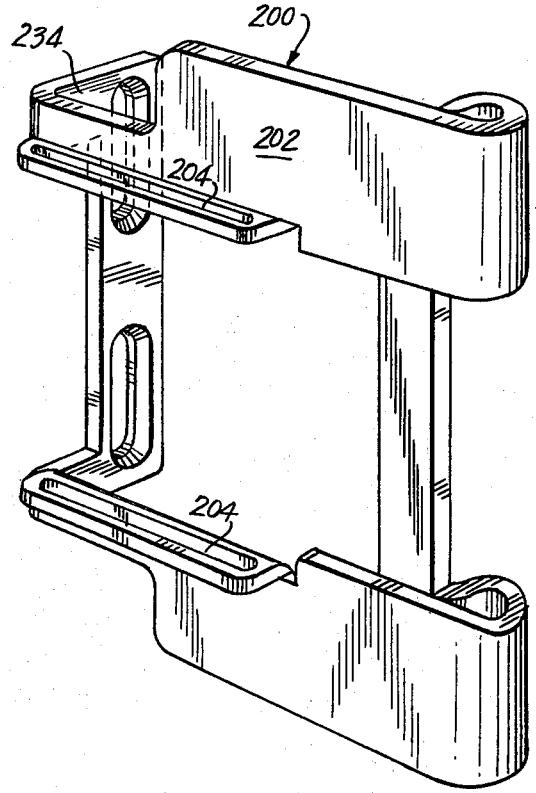
FIG. 29 is an enlarged perspective view of another embodiment of the interior leaf which is mounted on the cabinet.

Referring now to FIG. 28, the inner leaf 20 is shown. A front face 202 of the inner leaf 200 may be provided with opening 203 through which screws or bolts 205 may be used for fastening the inner leaf 200 to the face frame 12. If desired, adhesives or other suitable fastening means may be used for attaching the inner leaf 200 to the face frame.

Extending outward from the front face 202 of the inner leaf 200 are upper and lower guides 204. In this embodiment, pins 210 on the inner end 208 of the forcing member 206 are engageable in respective guides 204 and slide there along.

Thusly, the first pivot is defined and said pivot is movable in relation to the front face 202 of the inner leaf 200.

Unlike the forcing member of the other embodiments, the forcing member 206 of this embodiment may be made substantially straight (See FIGS. 25 and 26) and said forcing member 206 includes two substantially parallel leg portions 212.

The pivoting member 218 of this embodiment is substantially similar to the pivoting member of the other two embodiments. The inner end 217 of the pivoting member 218 is attached to curls on the inner legs, as was done in the other embodiments, in order to define the second pivot. The outer end 219 of the pivoting member 218 is attached to curl like structures in the outer leaf 228, as was done in the other embodiments, in order to define the third pivot.

In this embodiment, the upper and lower legs 215 of the pivoting member 218 are provided with wing portions 216. An axle 214 passes through an opening in the upper and lower legs 212 of the forcing member 206 and is retained in a respective opening in the wing portion 216 of the pivoting member 218. In such manner, a fourth pivot is defined. It should be pointed out that separate axles may be used to attach the wing portions to respective upper and lower legs 212 of the forcing member 206. It is also possible to provide a forcing member 206 with one continuous surface, instead of two legs, and to provide one relatively long axle to connect this surface to the winged portions.

In the enclosed position of the hinge (See FIG. 23), the pins 210 on the inner end 208 of the forcing member 206 are at the extreme outer (or left most) portion of the guides 204. As the door is opened, the pins 210 move along the guides 204 and cause the forcing member 206 to move away from the cabinet. Since the pivoting member 218 is mechanically linked to the forcing member 206 by the axles 214, the pivoting member 218 is necessarily moved outward, in order to open the hinge (see FIG. 25). When the hinge reaches its open position (see FIG. 26), the door 16 may be rotated until it is fully opened (see the discussion concerning the other embodiments of the invention).

In order to provide optimum operability of this embodiment of the hinge, it is suggested that some type of locking means be used to hold the forcing member 206 in the open position, so that it does not slide back along the guides 204 to the closed position. The preferred locking device is a spring positioned around the axles 214 to maintain the forcing member 206 and the pivoting member 218 in the correct position (not shown).

Another type of locking device is a leaf tension spring to 220. The inner end 221 of the tension spring 220 is attached in some appropriate manner to the inner end of the front face 202 of the inner leaf 200. In the closed position of the hinge (see FIG. 23), the inner end 208 of the forcing member 206 is not in contact with the cup shaped end portion 223 of the tension spring 220. As the hinge is opened, the inner end at 208 of the forcing member 206 slides along the surface of the tension spring 220. (See FIG. 25). When the hinge is in its openmost position (see FIG. 26), the inner end 208 of the forcing member 206 is in engagement with the cup shaped end portion 223 of the tension spring 220. Thus, the tension spring 220 holds the forcing member 206 in the open position. By exerting a little force on the forcing member, as when the hinges close, the force of the tension spring may be overcome and the hinge may be closed.

Figure 27:
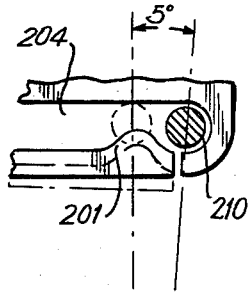
FIG. 27 is a top planned view of a modified form of the slide in which the first pivot is movable into a semi-locked position.

Another way to hold or lock the hinge in an open position, is to provide a protuberance 201 in the upper and lower guides 204 (see FIG. 27). This protuberance would be just before the innermost portion of the guides. Thus, when the forcing member 206 is in its openmost position, the pins 210 would be prevented by the protuberance 201 from moving back along the guides to the closed position. The protuberances 201, however, would be so made that, when it is intended that the hinge be closed, a slight amount of additional force would permit the pins to tend to pass back over the protuberances 201 and slide along the guides 204 to the closed position.

To close the door and the hinge, the door 16 is first rotated toward the face frame 12 of the cabinet. Then, the door 16 is pushed toward the cabinet and the hinge is closed. The movement of the pivoting member 218 toward the cabinet causes the forcing member 206 to rotate about the axles 214 and to cause the pins 210 to slide along the guides 204 to the closed position.

In order to provide better operation of the hinge of this embodiment, the outer end of the forcing member 206 may interact with a cam like structure on the inner surface of the outer leaf 228, as was done in the other embodiments (not shown).

In the preferred version of this embodiment, the outer ends of the 222 of the legs 212 of the forcing member 206 are provided with pins 224. These pins are engageable in respective guides 226 made in the inner surface of the outer leaf 228. Thus, the combination of the pins 224 and the guides 226 may define a fifth pivot point. In some embodiments, the pin 224 would be retained completely within the guides 226 and would not be capable of leaving the guides 226. Such an arrangement would necessarily restrict the amount that the door 16 could be opened. In order to alleviate this inconvenience, it is possible to provide the inner end of the guides 226 with an opening 230. When the door is now opened, the pins 224 may leave the guides 226 and permit the door 16 to be opened to any desired position. When the door is closed, rounded surfaces 232 may be provided on the open end 230 of the guides 226 to facilitate reentry of the pins 224 into the guides 226.

As can be appreciated, the exact positioning of the pins 224 on the outer ends 222 of the legs 212 may be varied and the guides 226 can be re-positioned with respect to the outer leaf 228. For instance, the forcing member 206 may be made of one continuous leg and pins could be provided at the outer end that extend from an upper surface and from a lower surface. The middle portion of the outer end of the forcing member would then enter into a channel in a block on the outer leaf 228 and the pins would travel in guides positioned above and below said channel. Other possible arrangements of the pins and of the guides are also possible.

As was true of the other embodiments of the invention, a self closing mechanism may be provided to facilitate closing of the hinge.

Figure 30:
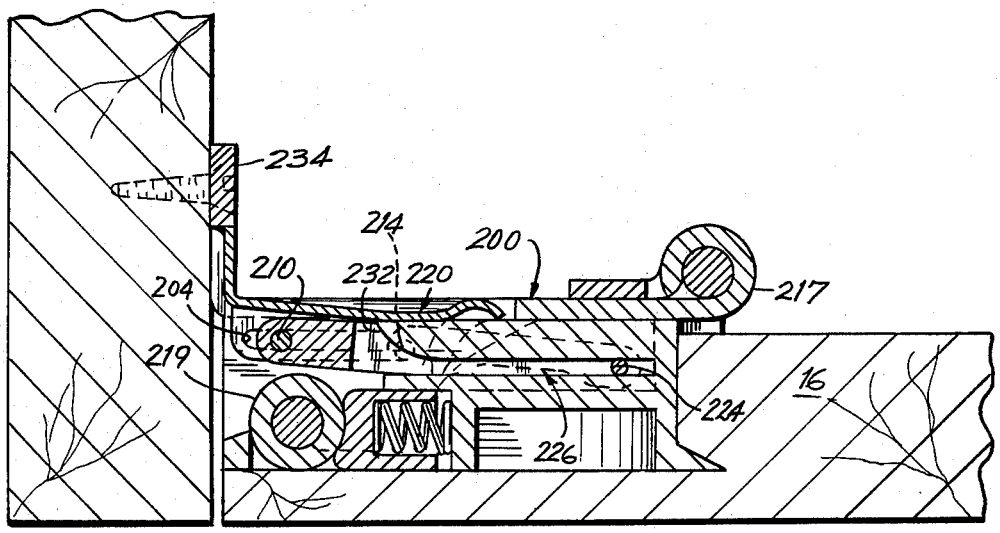
FIG. 30 is a view substantially similar to FIG. 23, but using the hinge member shown in FIG. 29 and where the door is mounted internally of the cabinet without the benefit of a face frame.
Figure 31:
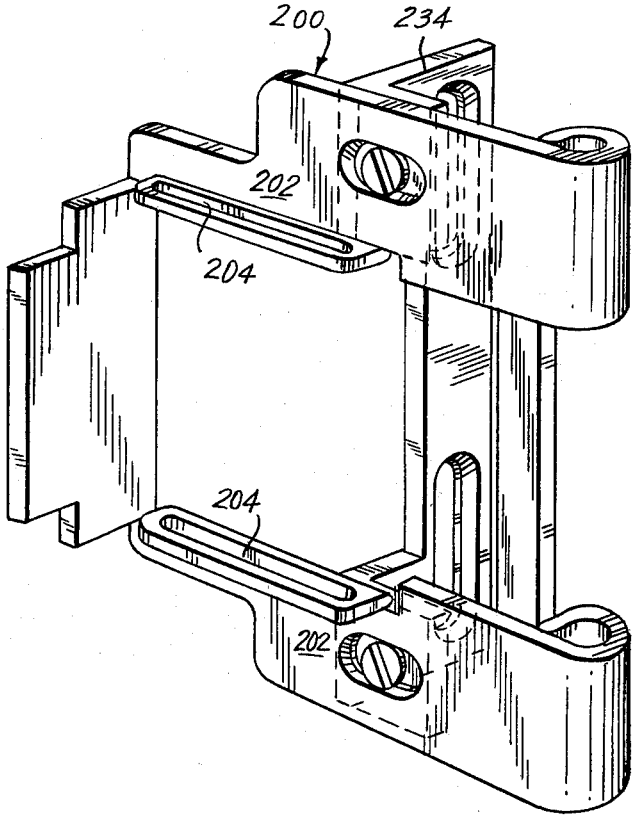
FIG. 31 is an enlarged perspective view of another embodiment of the interior leaf which is mounted on the inside wall of a cabinet.
Figure 32:
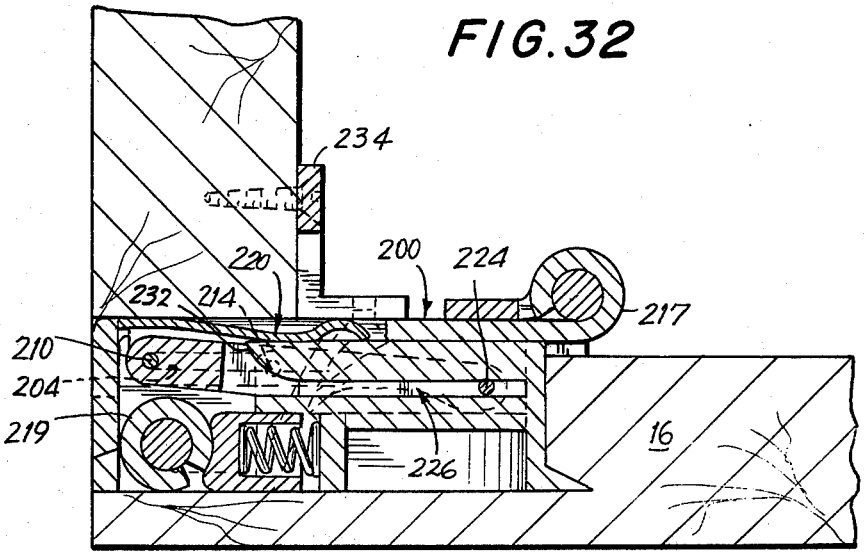
FIG. 32 is a view similar to that of FIG. 30, except that the door is mounted externally of the cabinet without a face frame.

Moreover, as was true of the other embodiments of the invention, this embodiment of the invention may also be used on cabinets that are not provided with face frames. For instance, FIG. 30 illustrates the hinge of this embodiment being used to mount a door internally of the outer edge of the cabinet, without the benefit of a face frame. To mount the hinge in such a position, a slight modification must be made to the inner leaf. A mounting plate or surface 234 is provided on the inner leaf 200 in a substantially parallel plane to that of the front face 202. It is this mounting plate 234 which is mounted to the inside edge of the cabinet. The hinge of this embodiment may also be mounted so that the door is flush with the outside edge of the cabinet, where a face frame is not used (See FIG. 32). Again, it is necessary to make a slight modification of the inner leaf in order to mount the hinge in this position. The mounting surface 234 would again be used, but it would be mounted at an approximate middle or intermediate portion of the front face 202 of the inner leaf 200 (See FIG. 31). In all other respects, the hinges shown in FIGS. 30 and 32 operate in the same manner as does the hinge shown in FIGS. 23–28.

Therefore, as can be seen from the above description, in its broadest scope, the invention comprises a hinge with three pivot points. The first pivot point is mounted on an outside or front surface of the cabinet, or face frame, and in close juxtaposition to the inner surface of the door when the hinge is closed; The second pivot point is mounted internally of the front surface of the cabinet, or on the side surface of a face frame when a face frame is used; and, the third pivot is mounted on the door. A pivoting member is pivotally connected to the second and third pivots. Pivotally connected to the first pivot is a forcing member which interacts, in some manner with the pivoting member in order to close the hinge. In some embodiments, the outer end of the pivoting member interacts with a cam on the inside of the door, in order to facilitate closing of the door. In other embodiments, the first pivot is slidingly mounted, in order to facilitate the movement of the forcing member. To provide optimum operability of the hinge, a fourth pivot point may be provided at the intersection of the forcing member and the pivoting member. A fifth pivoting point may also be provided and be defined by the outer end of the pivoting member and appropriate structure in the door, in order to provide the optimum operability of the hinge.

Attention is directed to the fact that the drawings in this application are not drawn to scale and that the relative sizes and dimensions as illustrated may not be accurate. The important relationship between components is that they be arranged and dimensioned so as to interact in the manner above described.

I claim:

1. A hinge for mounting a door on a cabinet comprising:

an interior leaf, for mounting to a cabinet, including first and second pivots;

an external leaf including a third pivot for fixed positioning within a recess in a door;

a pivoting member having a first end pivotally connected to said second pivot, and a second end pivotally connected to said third pivot;

a forcing member having a first end pivotally connected to said first pivot, said forcing member being operatively associated with said pivoting member; and forcing means urging said forcing member to interact with said pivoting member when said hinge is being moved to a closed position.

2. A hinge according to claim 1, wherein said first pivot is slidingly mounted on said interior leaf.

3. A hinge according to claim 2, wherein said forcing means includes axle means to connect said forcing member and said pivoting member to define a fourth pivot.

4. A hinge according to claim 3, wherein said interior leaf includes guides; and said forcing member has pins on an inner end interacting with said guides to define said first pivot.

5. A hinge according to claim 4, wherein said interior leaf includes a side face and a front face, which are substantially perpendicular to each other, and a mounting face, which is substantially perpendicular to said front face; said guides are positioned on said front face of said interior leaf; and said second pivot is fixedly positioned with respect to said side face of said interior leaf; and further comprising means for connecting said mounting face of said interior leaf to said cabinet.

6. A hinge according to claim 1, wherein a tangent to an outermost point of said second pivot is in approximately the same plane as a tangent to an innermost point of said first pivot.

7. A hinge according to claim 1, wherein said interior leaf includes a side face and a front face, which are substantially perpendicualr to each other; said first pivot is fixedly positioned on said front face of said interior leaf; and said second pivot is fixedly positioned with respect to said side face of said interior leaf, a tangent to an outermost point of said second pivot being in substantially the same plane as said front face of said interior leaf.

8. A hinge according to claim 7, wherein said interior leaf further includes a mounting face, which is substantially perpendicular to said front face; and further comprising means for connecting said mounting face of said interior leaf to a side panel of a cabinet.

9. A hinge according to claim 1, wherein said interior leaf includes a side face, a front face and a mounting face, said side face and said front face being substantially perpendicular to each other; said first pivot is fixedly positioned at a junction of said front face and said mounting face of said interior leaf; and said second pivot is fixedly positioned with respect to said side face of said interior leaf, a tangent to an outermost point of said second pivot being in substantially the same plane as said front face of said interior leaf.

10. A hinge according to claim 9, further comprising:

means for connecting said mounting face of said interior leaf to a side panel of a cabinet.

11. A hinge for mounting a door on a cabinet having a face frame which includes an inside edge and an outside surface which are substantially perpendicular to each other, comprising:

a first pivot for fixed positioning with respect to said outside surface of said face frame;

a second pivot for fixed positioning with respect to said inside edge of said face frame;

a third pivot for fixed positioning within a recess in said door;

a pivoting member having a first end pivotally connected to said second pivot, and a second end pivotally connected to said third pivot;

a forcing member having a first end pivotally connected to said first pivot, said forcing member operatively associated with said pivoting member; and a forcing means urging said forcing member to interact with said pivoting member when said hinge is being moved to a closed position.

12. A hinge according to claim 11, wherein said first pivot is slidingly mounted on said interior leaf.

13. A hinge according to claim 12, wherein said forcing means includes axle means to connect said forcing member and said pivoting member to define a fourth pivot.

14. A hinge according to claim 13, wherein said interior leaf includes guides; and said forcing member has pins on an inner end interacting with said guides to define said first pivot.

15. A hinge according to claim 14, wherein said interior leaf includes a side face and a front face, which are substantially perpendicular to each other; said guides are positioned on said front face of said interior leaf; and said second pivot is fixedly positioned with respect to said side face of said interior leaf.

16. A hinge according to claim 15, further comprising means for attaching said interior leaf to said second member.

17. A hinge according to either claim 5 or 15, wherein said forcing means includes a cam means disposed in a recess of said external leaf, a distal end of said forcing member being engageable with said cam means when said hinge is being moved to a closed position.

18. A hinge according to either claims 5 or 15, wherein said forcing means includes guides positioned in said recess of said external leaf and pins on an outer end of said forcing member interacting with said guides to define a sliding fifth pivot.

19. A hinge according to claim 18, wherein both ends of said guides on said external leaf are closed.

20. A hinge according to claim 18, wherein a first end of said guides on said external leaf are closed and a second end is open to permit said pins on said outer end of said forcing member to leave said guides to permit greater opening of said hinge.

21. A hinge according to claim 18, wherein said second pivot includes curls on said side surface of said interior leaf and curls on an inner end of said pivoting member, a hinge pin connecting said curls of said interior leaf and said inner end of said pivoting member to define said second pivot; and said third pivot includes curl-like structures in said recess of said external leaf and curls on an outer end of said pivoting member, a hinge pin connecting said curls of said outer end of said pivoting member and said curl-like structures to define said third pivot.

22. A hinge according to claim 18, further comprising a locking means to hold said hinge in an open position.

23. A hinge according to claim 22, wherein said locking means includes a leaf tension spring having a first end attached to said interior leaf and a second end with a cup-like shape, said inner end of said forcing member interacting with said second end of said spring when said hinge is in an open position.

24. A hinge according to claim 22, wherein said locking means includes a spring positioned around said axle means.

25. A hinge according to claim 22, wherein said locking means includes protuberances made in said guides on said interior leaf near an inner end of said guides.

26. A hinge according to claim 11, wherein a tangent to an outermost point of said second pivot is in substantially the same plane as a tangent to an innermost point of said first pivot.

27. A hinge according to claim 11, further comprising an interior leaf for mounting to said face frame; and wherein said first pivot is fixedly positioned on said interior leaf with respect to said outside surface of said face frame; and said second pivot is fixedly positioned on said interior leaf with respect to said inside edge of said face frame.

28. A hinge according to claim 27, wherein said interior leaf includes a side face and a front face, which are substantially perpendicular to each other; said first pivot is fixedly positioned on said front face of said interior leaf; and said second pivot is fixedly positioned with respect to said side face of said interior leaf, a tangent to an outermost point of said second pivot being in substantially the same plane as said front face of said interior leaf.

29. A hinge according to claim 28, further comprising means for attaching said interior leaf to said face frame.

30. A hinge according to claim 29, wherein said means for attaching includes means for attaching said side face of said interior leaf to said inside edge of said face frame.

31. A hinge according to claim 28, further comprising an external leaf for fixed positioning within a recess in said door, said third pivot being positioned on said external leaf.

32. A hinge according to either claim 7, 9, or 31 wherein:

said external leaf includes a recess;

said forcing means includes a cam means disposed in said recess of said external leaf;

said forcing member includes inner and outer sections disposed at an angle to each other, said inner section of said forcing member being pivotally connected to said first pivot, a distal end of said outer section being engageable with said cam means when said hinge is being moved to a closed position, and a forcing element being defined near a junction of said inner and outer sections; and said pivoting member includes an inner portion pivotally connected to said pivot, a middle portion, and an outer portion pivotally connected to said third pivot, said inner portion having a surface in movable engagement with said forcing element of said forcing member, and said forcing element exerting a force on said surface of said inner portion of said pivoting member to move said pivoting member toward said interior leaf when said cam means engages said distal end of said outer section of said forcing member.

33. A hinge according to claim 32, wherein:

said forcing member further includes a stop means extending downward from said member at a point near said junction of said inner and outer sections; and said pivoting member further includes a stopping region defined at a junction of said inner and middle portions, said forcing element moving along said surface of said inner portion of said pivoting member towards said stopping region when said hinge is being moved to an open position, and further motion of said forcing element along said surface of said inner portion of said pivoting member ceasing when said stop means engages said stop region.

34. A hinge according to claim 33, wherein said middle portion of said pivoting member includes an opening through which said forcing member moves.

35. A hinge according to claim 34, wherein:

said first and second pivots include curls on said front and side faces of said interior leaf, respectively;

said pivoting member includes curls on an end of said inner portion and a curl on an end of said outer portion, a hinge pin being used to connect said curls of said side face of said interior leaf and said curls of said inner portion of said pivoting member to define said second pivot, so that said pivoting member is pivotally arranged with respect to said interior leaf;

said inner section of said forcing member includes a curl, a hinge pin being used to connect said curls of said front face of said interior leaf and said curl of said forcing member to define said first pivot, so that a said forcing member is pivotally arranged with respect to said interior leaf; and said recess of said external leaf includes curl-like structures, a hinge pin connecting said curl-like structures and said curl on said outer portion of said pivoting member to define said third pivot, so that said pivoting member is pivotally arranged with respect to said external leaf.

36. A hinge according to claim 35, wherein a biasing means is included around a respective hinge pin between said curls on said side face of said interior leaf to force said hinge into said open position.

37. A hinge according to claim 35, wherein said front face of said interior leaf includes substantially parallel legs separated by an opening, said curls of said front face of said interior leaf being defined by distal ends of said legs, and said inner portion of said pivoting member being disposed between said legs of said front face of said interior leaf and substantially parallel to said front face of said interior leaf when said hinge is in said closed position; and wherein said curls of said side face of said interior leaf are positioned on a front edge of said side face.

38. A hinge according to claim 35, wherein said inner section of said forcing member includes two substantially parallel legs with an opening defined between them, said curl of said forcing member being defined on distal ends of said legs of said inner section of said forcing member; and wherein said outer section of said forcing member includes two substantially parallel legs with a spacing defined between them, one end of each of said legs of said outer section of said forcing member being connected, and disposed at an angle, to a respective leg of said inner section of said forcing member, said stop means extending downward from a junction of lower legs of each of said inner and outer sections of said forcing member, and said distal end of said outer section of said forcing member including an arcuate leg connecting distal ends of said legs of said outer section of said forcing member.

39. A hinge according to claim 35, wherein said middle portion of said pivoting member includes two substantially parallel legs separated by an opening, first ends of said legs of said middle portion of said pivoting member being connected, and disposed at an angle, to said surface of said inner portion of said pivoting member, said stopping region being defined at a junction between said legs of said middle portion and said surface of said inner portion of said pivoting member, and second ends of said legs of said middle portion of said pivoting member being connected, and being disposed at an angle, to said outer portion of said pivoting member.

40. A hinge according to claim 35, further comprising a limiting means positioned in said recess of said external leaf and interacting with said outer portion of said pivoting member to restrict opening of the hinge.

41. A hinge according to either claim 7, 9, or 31 wherein:

said external leaf includes a recess;

said forcing means includes a cam means disposed in said recess of said external leaf;

said forcing member includes inner and outer sections disposed at an angle to each other, said inner section of said forcing member being pivotally connected to said first pivot, a distal end of said outer section being engageable with said cam means when said hinge is being moved to a closed position, and forcing shoulders being defined near a junction of said inner and outer sections; and said pivoting member includes an inner portion pivotally connected to said second pivot, a middle portion, and an outer portion pivotally connected to said third pivot, said middle portion having abutment portions engageable with said forcing shoulders of said forcing member, and said forcing shoulders exerting a force on said abutment portions of said middle portion of said pivoting member to move said pivoting member toward said interior leaf when said cam means engages said distal end of said outer section of said forcing member.

42. A hinge according to claim 41, wherein:

said forcing member further includes a stop means extending downward from said forcing member at a point near said junction of said inner and outer sections; and said pivoting member further includes a stopping region defined at a junction of said inner and middle portions, and, when said hinge is being moved to an open position, further opening movement of said hinge ceasing when said stop means engages said stop region.

43. A hinge according claim 42, wherein said middle portion of said pivoting member includes an opening through which said forcing member moves.

44. A hinge according to claim 43, wherein:

said first and second pivots include curls on said front and side faces of said interior leaf, respectively;

said pivoting member includes curls on an end of said inner portion and a curl on an end of said outer portion, a hinge pin being used to connect said curls of said face of said interior leaf and said curls of said inner portion of said pivoting member to define said second pivot, so that said pivoting member is pivotally arranged with respect to said interior leaf;

said inner section of said forcing member includes a curl, a hinge pin being used to connect said curls of said front face of said interior leaf and said curl of said forcing member to define said first pivot, so that said forcing member is pivotally arranged with respect to said interior leaf; and said recess of said external leaf includes curl-like structures, a hinge pin connecting said curl-like structures and said curl on said outer portion of said pivoting member to define said third pivot, so that said pivoting member is pivotally arranged with respect to said external leaf.

45. A hinge according to claim 44, wherein a biasing means is included around a respective hinge pin between said curls on said side face of said interior leaf to force said hinge into said open position.

46. A hinge according to claim 44, wherein said front face of said interior leaf includes substantially parallel legs separated by an opening, said curls of said front face of said interior leaf being defined on distal ends of said legs, and said inner portion of said pivoting member being disposed between said legs of said front face of said interior leaf and substantially parallel to said front face of said interior leaf when said hinge is in said closed position; and wherein said curls of said side face of said interior leaf are positioned on a front edge of said side face.

47. A hinge according claim 44, wherein said inner section of said forcing member includes two substantially parallel legs with an opening defined between them, said curl of said forcing member being defined on distal ends of said legs of said inner section of said forcing member; and wherein said outer section of said forcing member includes two substantially parallel legs with a spacing defined between them, one end of each of said legs of said outer section of said forcing member being connected, and disposed at an angle, to a respective leg of said inner section of said forcing member, said stop means extending downward from a junction of lower legs of each of said inner and outer sections of said forcing member, and said distal end of said outer section of said forcing member including an arcuate leg connecting distal ends of said legs of said outer section of said forcing member.

48. A hinge according to claim 44, wherein said middle portion of said pivoting member includes two substantially parallel legs separated by an opening, first ends of said legs of said middle portion of said pivoting member being connected, and disposed at an angle, to said surface of said inner portion of said pivoting member, said stopping region being defined at a junction between said legs of said middle portion and said surface of said inner portion of said pivoting member, second ends of said legs of said middle portion of said pivoting member being connected, and being disposed at an angle, to said outer portion of said pivoting member, and said abutment portions extending outward from said inner portion and said legs of said middle portion into said opening defined between said legs of said middle portion.

49. A hinge according to claim 44, further comprising a limiting means positioned in said recess of said external leaf and interacting with said outer portion of said pivoting member to restrict opening of the hinge.

50. A hinge for mounting a first member to a second member comprising;

a first pivot for positioning to said second member;

a second pivot for fixed positioning to said second member;

a third pivot for fixed positioning within a recess in said first member;

a pivoting member having a first end pivotally connected to said second pivot, and a second end pivotally connected to said third pivot;

a forcing member having a first end pivotally connected to said first pivot, said forcing member being operatively associated with said pivoting member; and a forcing means urging said forcing member to interact with said pivoting member when said hinge is being moved to a closed position.

51. A hinge according to claim 50, wherein a tangent to an outermost point on said second pivot is in substantially the same plane as a tangent to an innermost point on said first pivot.

52. A hinge according to claim 50, further comprising:

an interior leaf for mounting to said second member, said first and second pivots being positioned on said interior leaf.

53. A hinge according to claim 52, wherein said interior leaf includes a side face and a front face, which are substantially perpendicular to each other; said first pivot is fixedly positioned on said front face of said interior leaf; and said second pivot is fixedly positioned with respect to said side face of said interior leaf, a tangent to an outermost point of said second pivot being in substantially the same plane as said front face of said interior leaf.

54. A hinge according to claim 53, wherein said interior leaf further includes a mounting face, which is substantially perpendicular to said front face; and further comprising means for connecting said mounting face of said interior leaf to said second member.

55. A hinge according to claim 52, wherein said interior leaf includes a side face, a front face and a mounting face, said side face and said front face being substantially perpendicular to each other and said mounting face and said front face being substantially perpendicular to each other; said first pivot is fixedly positioned at a junction of said front face and said mounting face of said interior leaf; and said second pivot is fixedly positioned with respect to said side face of said interior leaf, a tangent to an outermost point of said second pivot being in substantially the same plane as said front face of said interior leaf.

56. A hinge according to claim 55, further comprising means for connecting said mounting face of said interior leaf to said second member.

57. A hinge according to either claim 53 or 55, further comprising:

an external leaf, for mounting on said first member, including a recess, said third pivot being fixedly positioned on said external leaf; and wherein said forcing means includes a cam means disposed in said recess of said external leaf;

said forcing member includes inner and outer sections disposed at an angle to each other, said inner section of said forcing member being pivotally connected to said first pivot, a distal end of said outer section being engageable with said cam means when said hinge is being moved to said closed position, and a forcing element being defined at a junction of said inner and outer sections; and said pivoting member includes an inner portion pivotally connected to said second pivot, a middle portion, and an outer portion pivotally connected to said third pivot, said inner portion having a surface in movable engagement with said forcing element of said forcing member, and said forcing element exerting a force on said surface of said inner portion of said pivoting member to move said pivoting member toward said interior leaf when said cam means engages said distal end of said outer section of said forcing member.

58. A hinge according to claim 57, wherein:

said forcing member further includes a stop means extending downward from said forcing member at a point near said junction of said inner and outer sections; and said pivoting member further includes a stopping region defined at a juntion of said inner and middle portions, said forcing element moving along said surface of said inner portion of said pivoting member towards said stopping region when said hinge is being moved to an open position, and further motion of said forcing element along said surface of said inner portion of said pivoting member ceasing when said stop means engages said stop region.

59. A hinge according to claim 58, wherein said middle portion of said pivoting member includes an opening through which said forcing member moves.

60. A hinge according to claim 59, wherein:

said first and second pivots include curls on said front and side faces of said interior leaf, respectively;

said pivoting member includes curls on an end of said inner portion and a curl on an end of said outer portion, a hinge pin being used to connect said curls of said face of said interior leaf and said curls of said inner portion of said pivoting member to define said second pivot, so that said pivoting member is pivotally arranged with respect to said interior leaf;

said inner section of said forcing member includes a curl, a hinge pin being used to connect said curls of said front face of said interior leaf and said curl of said forcing member to define said first pivot, so that said forcing member is pivotally arranged with respect to said interior leaf; and said recess of said external leaf includes curl-like structures, a hinge pin connecting said curl-like structures and said curl on said outer portion of said pivoting member to define said third pivot, so that said pivoting member is pivotally arranged with respect to said external leaf.

61. A hinge according to claim 60, wherein a biasing means is included around a respective hinge pin between said curls on said side face of said interior leaf to force said hinge into said open position.

62. A hinge according to claim 60, wherein said front face of said interior leaf includes substantially parallel legs separated by an opening, said curls of said front face of said interior leaf being defined on distal ends of said legs, and said inner portion of said pivoting member being disposed between said legs of said front face of said interior leaf and substantially parallel to said front face of said interior leaf when said hinge is in said closed position; and wherein said curls of said side face of said interior leaf are positioned on a front edge of said side face.

63. A hinge according to claim 60, wherein said inner section of said forcing member includes two substantially parallel legs with an opening defined between the, said curl of said forcing member being defined on distal ends of said legs of said inner section of said forcing member; and wherein said outer section of said forcing member includes two substantially parallel legs with a spacing defined between them, one end of each of said legs of said outer section of said forcing member being connected, and disposed at an angle, to a respective leg of said inner section of said forcing member, said stop means extending downward from a junction of lower legs of each of said inner and outer sections of said forcing member, and said distal end of said outer section of said forcing member including an arcuate leg connecting distal ends of said legs of said outer section of said forcing member.

64. A hinge according to claim 60, wherein said middle portion of said pivoting member includes two substantially parallel legs separated by an opening, first ends of said legs of said middle portion of said pivoting member being connected, and disposed at an angle, to said surface of said inner portion of said pivoting member, said stopping region being defined at a junction between said legs of said middle portion and said surface of said inner portion of said pivoting member, and second ends of said legs of said middle portion of said pivoting member being connected, and being disposed at an angle, to said outer portion of said pivoting member.

65. A hinge according to claim 60, further comprising a limiting means positioned in said recess of said external leaf and interacting with said outer portion of said pivoting member to restrict opening of the hinge.

66. A hinge according to either claim 53 or 55, further comprising:

An external leaf, for mounting on said first member, including a recess, said third pivot being fixedly positioned on said external leaf; and wherein said forcing means includes a cam means disposed in said recess of said external leaf:

said forcing member includes inner and outer sections disposed at an angle to each other, said inner section of said forcing member being pivotally connected to said first pivot, a distal end of said outer section being engageable with said cam means when said hinge is being moved to said closed position, and forcing shoulders being defined near a junction of said inner and outer sections; and said pivoting member includes an inner portion pivotally connected to said second pivot, a middle portion, and an outer portion having abutment portions engageable with said forcing shoulders of said forcing member, and said forcing shoulders exerting a force on said abutment portions of said middle portion of said pivoting member to move said pivoting member toward said interior leaf when said cam means engages said distal end of said outer section of said forcing member.

67. A hinge according to claim 66, wherein:

said forcing member further includes a stop means extending downward from said forcing member at a point near said junction of said inner and outer sections; and said pivoting member further includes a stopping region defined at a junction of said inner and middle portions, and, when said hinge is being moved to an open position, further opening movement of said hinge ceasing when said stop means engages said stop region.

68. A hinge according to claim 67, wherein said middle portion of said pivoting member includes an opening through which said forcing member moves.

69. A hinge according to claim 68, wherein:

said first and second pivots include curls on said front and side faces of said interior leaf, respectively;

said pivoting member includes curls on an end of said inner portion and a curl on an end of said outer portion, a hinge pin being used to connect said curls of said face of said interior leaf and said curls of said inner portion of said pivoting member to define said second pivot, so that said pivoting member is pivotally arranged with respect to said interior leaf;

said inner section of said forcing member includes a curl, a hinge pin being used to connect said curls of said front face of said interior leaf and said curl of said forcing member to define said first pivot, so that said forcing member is pivotally arranged with respect to said interior leaf; and said recess of said external leaf includes curl-like structures, a hinge pin connecting said curl-like structures and said curl on said outer portion of said pivoting member to define said third pivot, so that said pivoting member is pivotally arranged with respect to said external leaf.

70. A hinge according to claim 68, wherein a biasing means is included around a respective hinge pin between said curls on said side face of said interior leaf to force said hinge into said open position.

71. A hinge according to claim 68, wherein said front face of said interior leaf includes substantially parallel legs separated by an opening, said curls of said front face of said interior leaf being defined on distal ends of said legs, and said inner portion of said pivoting member being disposed between said legs of said front face of said interior leaf and substantially parallel to said front face of said interior leaf when said hinge is in said closed position; and wherein said curls of said side face of said interior leaf are positioned on a front edge of said side face.

72. A hinge according to claim 68, wherein said inner section of said forcing member includes two substantially parallel legs with an opening defined between them, said curl of said forcing member being defined on distal ends of said legs of said inner section of said forcing member; and wherein said outer section of said forcing member includes two substantially parallel legs with a spacing defined between them, one end of each of said legs of said outer section of said forcing member being connected, and disposed at an angle, to a respective leg of said inner section of said forcing member, said stop means extending downward from a junction of lower legs of each of said inner and outer sections of said forcing member, and said distal end of said outer section of said forcing member including an arcuate leg connecting distal ends of said legs of said outer section of said forcing member.

73. A hinge according to claim 68, wherein said middle portion of said pivoting member includes two substantially parallel legs separated by an opening, first ends of said legs of said middle portion of said pivoting member being connected, and disposed at an angle, to said surface of said inner portion of said pivoting member, said stopping region being defined at a junction between said legs of said middle portion and said surface of said inner portion of said pivoting member, second ends of said legs of said middle portion of said pivoting member being connected, and being disposed at an angle, to said outer portion of said pivoting member, and said abutment portions extending outward from said inner portion and said legs of said middle portion into said opening defined between said legs of said middle portion.

74. A hinge according to claim 68, further comprising a limiting means positioned in said recess of said external leaf and interacting with said outer portion of said pivoting member to restrict opening of the hinge.

75. A hinge according to claim 50, wherein said first pivot is slidingly mounted on said second member.

76. A hinge according to claim 75, wherein said forcing means includes axle means to connect said forcing member and said pivoting member to define a fourth pivot.

77. A hinge according to claim 76 further comprising:

an interior leaf for mounting to said second member, said first pivot being slidingly mounted and said second pivot being fixedly positioned on said interior leaf.

78. A hinge according to claim 77, wherein said interior leaf includes guides; and said forcing member has pins on an inner end interacting with said guides to define said first pivot.

79. A hinge according to claim 78, wherein said interior leaf includes a side face and a front face, which are substantially perpendicular to each other; said guides are positioned on said front face of said interior leaf; and said second pivot is fixedly positioned with respect to said side face of said interior leaf.

80. A hinge according to claim 79, further comprising means for attaching said interior leaf to said second member.

81. A hinge according to claim 79, wherein interior leaf further includes a mounting face, which is substantially perpendicular to said front face; and further comprising means for connecting said mounting face of said interior leaf to said second member.

82. A hinge according to claim 79, further comprising:

an external leaf mounted on said first member and including a recess, said third pivot being fixedly positioned on said external leaf; and wherein said forcing means includes a cam means disposed in said recess of said external leaf, a distal end of said forcing member being engageable with said cam means when said hinge is being moved to said closed position.

83. A hinge according to claim 79, further comprising:

an external leaf mounted on said first member and including a recess, said third pivot being fixedly positioned on said external leaf; and wherein said forcing means includes guides positioned in said recess of said external leaf and pins on an outer end of said forcing member interacting with said guides to define a sliding fifth pivot.

84. A hinge according to claim 83, wherein both ends of said guides on said external leaf are closed.

85. A hinge according to claim 83, wherein a first end of said guides on said external leaf are closed and a second end is open to permit said pins on said outer end of said forcing member to leave said guides to permit greater opening of said hinge.

86. A hinge according to claim 83, wherein said second pivot includes curls on said side surface of said interior leaf and curls on an inner end of said pivoting member, a hinge pin connecting said curls of said interior leaf and said inner end of said pivoting member to define said second pivot; and said third pivot includes curl-like structures in said recess of said external leaf and curls on an outer end of said pivoting member, a hinge pin connecting said curls of said outer end of said pivoting member and said curl-like structures to define said third pivot.

87. A hinge according to claim 78, 79, or 83, further comprising a locking means to hold said hinge in an open position.

88. A hinge according to claim 87, wherein said locking means includes a leaf tension spring having a first end attached to said interior leaf and a second end with a cup-like shape, said inner end of said forcing member interacting with said second end of said spring when said hinge is in an open position.

89. A hinge according to claim 87, wherein said locking means includes a spring positioned around said axle means.

90. A hinge according to claim 87, wherein said locking means includes protuberances made in said guides on said interior leaf near an inner end of said guides.

* * * * *